US007564029B2

(12) United States Patent
Wang et al.

(10) Patent No.: US 7,564,029 B2
(45) Date of Patent: Jul. 21, 2009

(54) SAMPLE IONIZATION AT ABOVE-VACUUM PRESSURES

(75) Inventors: Mingda Wang, Fremont, CA (US); Charles A. Fancher, San Francisco, CA (US); Felician Muntean, Danville, CA (US); Urs Steiner, Sunnyvale, CA (US)

(73) Assignee: Varian, Inc., Palo Alto, CA (US)

( * ) Notice: Subject to any disclaimer, the term of this patent is extended or adjusted under 35 U.S.C. 154(b) by 174 days.

(21) Appl. No.: 11/893,308

(22) Filed: Aug. 15, 2007

(65) Prior Publication Data

US 2009/0045330 A1 Feb. 19, 2009

(51) Int. Cl.
*H01J 49/26* (2006.01)

(52) U.S. Cl. ..... 250/288

(58) Field of Classification Search ..... 250/288
See application file for complete search history.

(56) References Cited

U.S. PATENT DOCUMENTS

| | | | |
|---|---|---|---|
| 4,300,044 | A | 11/1981 | Iribarne et al. |
| 4,963,736 | A | 10/1990 | Douglas et al. |
| 4,977,320 | A | 12/1990 | Chowdhury et al. |
| 5,412,208 | A | 5/1995 | Covey et al. |
| 5,736,741 | A | 4/1998 | Bertsch et al. |
| 5,756,994 | A | 5/1998 | Bajic |
| 6,177,669 | B1 | 1/2001 | Wells et al. |
| 6,410,914 | B1 | 6/2002 | Park et al. |
| 6,410,915 | B1 | 6/2002 | Bateman et al. |
| 6,426,226 | B1 | 7/2002 | Senkan |
| 6,429,426 | B1 | 8/2002 | Doring |
| 6,462,336 | B1 | 10/2002 | Bajic |
| 6,541,768 | B2 | 4/2003 | Andrien, Jr. et al. |
| 6,573,494 | B1 | 6/2003 | Andrien, Jr. et al. |
| 6,653,626 | B2 | 11/2003 | Fischer et al. |
| 6,700,119 | B1 | 3/2004 | Giles |
| 6,794,646 | B2 | 9/2004 | Tong et al. |
| 6,818,888 | B2 | 11/2004 | Wells et al. |
| 7,078,681 | B2 | 7/2006 | Fischer et al. |
| 7,091,477 | B2 | 8/2006 | Jolliffe et al. |
| 7,145,136 | B2 | 12/2006 | Yang et al. |
| 7,193,206 | B2 | 3/2007 | Bai et al. |
| 7,488,953 | B2 * | 2/2009 | Fischer et al. ..... 250/425 |

FOREIGN PATENT DOCUMENTS

WO WO 0062054 A1 10/2000

* cited by examiner

*Primary Examiner*—Kiet T Nguyen
(74) *Attorney, Agent, or Firm*—Bella Fishman

(57) ABSTRACT

Sample material ionized in a sample receiving chamber is flowed into a sample conduit. Drying gas may also flow into the sample conduit and may be heated. The pressure and length of the sample conduit may be provided according to the product 50 or greater Torr–cm. The sample conduit may include a turn. The sample conduit may lead to an ion extraction chamber at which a sampling orifice may lead to a mass spectrometer. The diameter of the sample conduit may be larger than the diameter of the sampling orifice. An electrical field may be applied in the ion extraction chamber to slow incoming ions. A voltage jump may be applied to the sample conduit.

24 Claims, 11 Drawing Sheets

SAMPLE IONIZATION AT ABOVE-VACUUM PRESSURES

FIELD OF THE INVENTION

The present invention relates generally to ionization of sample material performed at pressures above vacuum. This type of ionization may be performed, for example, for providing ions for introduction into an analytical instrument such as a mass spectrometer.

BACKGROUND OF THE INVENTION

Certain techniques, such as in analytical chemistry, require that components of a sample be ionized prior to analysis. Mass spectrometry (MS) is an example of such analytical techniques. Generally, MS encompasses a variety of instrumental methods of qualitative and quantitative analysis that enable ionized species of analytes (i.e., sample molecules of interest) to be resolved according to their mass-to-charge ratios. For this purpose, an MS system converts the components of a sample into ions, sorts or separates the ions based on their mass-to-charge ratios, and processes the resulting ion output (e.g., ion current, flux, beam, etc.) as needed to produce a mass spectrum. Typically, a mass spectrum is a series of peaks indicative of the relative abundances of charged components as a function of mass-to-charge ratio.

A typical MS system includes a sample inlet system, an ion source or ionization device, a mass analyzer, an ion detector, a signal processor, a readout/display means, and an electronic controller such as a computer. The MS system also includes a vacuum system to enclose the mass analyzer(s) in a controlled, evacuated environment. In addition to the mass analyzer(s), depending on design, all or part of the sample inlet system, ion source, and ion detector may also be enclosed in the evacuated environment. One broad class of ion sources, however, ionizes sample material at or near atmospheric pressure in a region necessarily distinct from the vacuum or low-pressure regions of the mass analyzer. Atmospheric-pressure ionization (API) thus requires a structural interface to transport ions produced in the atmospheric-pressure environment of the API source to the evacuated environment of the mass spectrometer. API techniques are particularly useful when it is desired to couple mass spectrometry with an analytical separation technique such as liquid chromatography (LC). For instance, the output or effluent from an LC column may serve as the sample source or input into an API interface. Typically, the effluent consists of a liquid-phase matrix of analytes and mobile-phase material (e.g., solvents, additives, matrix components, etc.).

Examples of API techniques include electrospray ionization (ESI), atmospheric-pressure chemical ionization (APCI), atmospheric-pressure photoionization (APPI), and atmospheric-pressure matrix-assisted laser desorption/ionization (AP-MALDI). API techniques such as these are known and therefore need not be described in detail. As appreciated by persons skilled in the art, ESI is a desorption ionization technique characterized by the use of an electrically conductive electrospray needle. APCI is a gas-phase ionization technique characterized by the use of a corona discharge needle. APPI is characterized by the use of a photon source such as an ultraviolet (UV) lamp. AP-MALDI is characterized by the use of a pulsed laser beam and laser radiation-absorbing organic molecules.

Each technique typically employs an ionizing device extending into a chamber held at atmospheric pressure. The atmospheric-pressure chamber is physically separated from one or more vacuum or low-pressure regions of the mass spectrometer in which ion-guiding and mass-analyzing components reside. The ionizing device receives an analyte-bearing sample material from which the ionizing device produces a gaseous stream or spray that may comprise analyte ions, ion clusters, charged droplets, and neutral droplets. An inert nebulizing gas such as nitrogen ($N_2$) may be utilized to assist in forming this sample spray. The resulting sample spray is directed through the interior of the atmospheric-pressure chamber to a sampling orifice that leads to the mass spectrometer. One or more electrical fields may be generated in the atmospheric-pressure chamber to guide the sample spray toward the sampling orifice.

Ideally in conventional techniques, only the analyte ions enter the mass spectrometer, and not the other components of the spray such as neutral solvated droplets. In addition to the above-mentioned optional nebulizing gas, a stream of an inert drying gas such as nitrogen may be introduced into the atmospheric-pressure chamber to assist in the evaporation of solvent and/or sweep the solvent away from the sampling orifice. The drying gas may be heated prior to introduction into the chamber. The drying gas may be introduced through an annular opening formed by a tube that is coaxial with the sampling orifice, in counter-flow relation to the spray as the spray approaches the sampling orifice. Alternatively, the drying gas may be introduced as a curtain in front of the sampling orifice.

A recurring problem in API techniques such as those noted above is the entry of unwanted droplets and other non-analytical material into the sampling orifice that serves as the entry into the evacuated regions of the mass spectrometer. Such unwanted components may degrade the performance of the mass spectrometer and/or the quality of the mass spectral data produced thereby through contamination, reduction in sensitivity, reduction in robustness, peak tailing, etc. These problems can be exacerbated as the flow rate of sample material introduced into the ion source is increased. As previously noted, the API ion source has conventionally been provided with a counterflow or a curtain of a heated, dry inert gas such as nitrogen to protect the sampling orifice by evaporating and blowing away the unwanted components. These previous approaches, however, have failed to adequately prevent the entry of unwanted components into the sampling orifice, and do not provide a sufficient degree of contact between the drying gas and the spray of sample material. In addition, in the previous approaches, desolvation of entrained sample cluster ions and evaporation of liquid droplets are incomplete, and the efficiency with which ions are extracted into the mass spectrometer is less than desirable. It is desirable to increase collisions of solvated ions or cluster ions prior to their entering the mass spectrometer to thereby increase the signal-to-noise (S/N) ratio.

In addition, the sampling orifice conventionally employed as the exit from the atmospheric-pressure ionization chamber to the mass spectrometer typically serves as the direct interface between the ionization chamber and the first stage of the mass spectrometer. This sampling orifice is typically the inlet of a small-diameter, long capillary that drops the fluid pressure from atmospheric down to about 1-20 mTorr. The inside diameter of the sampling orifice (and associated length of capillary) is determined by the pumping system provided with the ionization/mass spectrometry apparatus. Because it is not practical to pump gaseous fluid in these types of systems at a flow rate much greater than 60 CFM, the inside diameter of the sampling orifice is typically held to around 5 μm. The small diameter of the sampling orifice and its use for sampling the ion-bearing stream directly from the ionization chamber into the mass spectrometer result in a large portion of the ions produced in the ionization chamber not being collected in the sampling orifice for analysis by the mass spectrometer.

The foregoing problems attending conventional systems employing API interfaces may result in less than desirable performance parameters, such as low sensitivity, low S/N ratio, low ion signal strength, insufficient separation of analyte ions from liquid droplets and matrix background components, insufficient evaporation of liquid droplets, insufficient collisions of solvated ions or cluster ions and thus insufficient desolvation, and high chemical background. Accordingly, there continues to be a need for improving ionization techniques that require environments of higher pressure than, and thus an interface with, the associated low-pressure/vacuum analytical instrument receiving the as-produced ions such as a mass spectrometer.

SUMMARY OF THE INVENTION

To address the foregoing problems, in whole or in part, and/or other problems that may have been observed by persons skilled in the art, the present disclosure provides apparatus, devices, systems and/or methods relating to proportional valves, as described by way of example in implementations set forth below.

According to one implementation, an ionization apparatus includes an interface chamber defined by a plurality of boundaries, and a heated sample conduit extending through the interface chamber. The sample conduit includes an inlet and an outlet, each of which is positioned within at least one of the boundaries. The sample conduit establishes a sample material flow path separated from an interface chamber interior. Within the sample conduit, a drying gas is mixed with the sample material flow and the product of the pressure times the length of said conduit is equal or greater than 50 torr×cm.

According to another implementation, an ionization apparatus includes an interface chamber including a plurality of boundaries defining an interface chamber interior, a drying gas inlet communicating with the interface chamber interior, and a sample conduit extending through the interface chamber and including a sample conduit inlet and a sample conduit outlet. The sample conduit inlet and the sample conduit outlet are positioned at at least one of the boundaries whereby the sample conduit establishes a sample material flow path separated from the interface chamber interior. The boundary at which the sample conduit inlet is positioned including a drying gas outlet proximate to the sample conduit inlet and communicating with the interface chamber interior, whereby the interface chamber establishes a drying gas flow path from the drying gas inlet, around the sample conduit and to the drying gas outlet.

According to another implementation, an ionization apparatus includes a sample receiving chamber including a boundary defining a sample receiving chamber interior, an ion extraction chamber separate from the sample receiving chamber and including an ion exit aperture and an exhaust aperture, and a sample conduit. The sample conduit includes an inlet communicating with the sample receiving chamber, an outlet communicating with the ion extraction chamber, and a length extending between the inlet and the outlet outside the sample receiving chamber. The sample conduit further includes a nonlinear section located in the length whereby the sample conduit establishes a sample material flow path that includes a turn.

According to another implementation, an ionization apparatus includes a sample receiving chamber including a boundary defining a sample receiving chamber interior, an ion extraction chamber separate from the sample receiving chamber and including an ion exit aperture and an exhaust aperture, a sample conduit communicating with the sample receiving chamber and the ion extraction chamber, and a device for applying an electrical field in the ion extraction chamber of a polarity opposite to the polarity of ions entering the ion extraction chamber from the sample conduit outlet.

According to another implementation, an ionization apparatus includes a sample receiving chamber including a boundary defining a sample receiving chamber interior, a sample conduit, and a device for accelerating or decelerating ions in the sample conduit. The sample conduit includes an inlet communicating with the sample receiving chamber, an outlet communicating with the ion extraction chamber, and a length extending between the inlet and the outlet outside the sample receiving chamber.

According to another implementation, a method for extracting ions from a sample material includes ionizing sample material in a sample receiving chamber. A sample conduit is provided within an interface chamber. Drying gas is flowed into the sample conduit for mixing an ionized sample material with the drying gas for obtaining within the sample conduit the product of the pressure times the length of the conduit being equal or greater than 50 torr×cm.

According to another implementation, a method for extracting ions from a sample material includes ionizing sample material in a sample receiving chamber. Heated drying gas is flowed into an interface chamber separate from the sample receiving chamber, around a sample conduit disposed in the interface chamber, and into the sample receiving chamber via a drying gas outlet. At least a portion of the ionized sample material and the drying gas is flowed from the sample receiving chamber into the sample conduit via a sample conduit inlet disposed proximate to the drying gas outlet. The heated drying gas in the interface chamber is utilized to heat the ionized sample material and the drying gas flowing through the sample conduit.

According to another implementation, a method for extracting ions from a sample material includes ionizing sample material in a sample receiving chamber, and flowing at least a portion of the ionized sample material along with drying gas from the sample receiving chamber, through a sample conduit and into an ion extraction chamber. The sample conduit defines a flow path for the ionized sample material and drying gas that includes a sample conduit inlet communicating with the sample receiving chamber, an outside section of the sample conduit disposed outside the sample receiving chamber, and a turn in the sample conduit located in the outside section.

According to another implementation, a method for extracting ions from a sample material includes ionizing sample material in a sample receiving chamber, flowing at least a portion of the ionized sample material along with drying gas from the sample receiving chamber to an ion extraction chamber, and applying an electrical field in the ion extraction chamber having a polarity opposite to the polarity of ions of the ionized sample material flowing into the ion extraction chamber to slow the flow rate of the ions as the ions enter the ion extraction chamber.

According to another implementation, a method for extracting ions from a sample material includes ionizing sample material in a sample receiving chamber, flowing at least a portion of the ionized sample material along with drying gas from the sample receiving chamber into a sample conduit extending outside the sample receiving chamber, and applying a voltage jump to the ionized sample material flowing through the sample conduit whereby charged species of the ionized sample material are accelerated or decelerated relative to uncharged species of the ionized sample material and the drying gas.

According to another implementation, an ionization apparatus includes a sample receiving chamber, a sample ionizing device communicating with the sample receiving chamber, a drying gas outlet communicating with the sample receiving chamber, a sample conduit communicating with the sample receiving chamber and including a sample conduit inlet and a sample conduit outlet, and an ion extraction chamber receiving the sample conduit outlet. The ion extraction chamber includes an ion exit orifice spaced from the sample conduit outlet by a gap. An inside diameter of the ion exit orifice is less than an inside diameter of the sample conduit outlet. A central axis of the ion exit orifice is substantially coincident with a central axis of the sample conduit outlet.

According to another implementation, a method for extracting ions from a sample material includes ionizing sample material in a sample receiving chamber at a pressure above atmospheric pressure, and flowing at least a portion of the ionized sample material along with drying gas from the sample receiving chamber, through a sample conduit and to an ion extraction chamber, the ion extraction chamber being at atmospheric pressure.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

In general, the term "communicate" (for example, a first component "communicates with" or "is in communication with" a second component) is used herein to indicate a structural, functional, mechanical, electrical, optical, magnetic, ionic or fluidic relationship between two or more components or elements. As such, the fact that one component is said to communicate with a second component is not intended to exclude the possibility that additional components may be present between, and/or operatively associated or engaged with, the first and second components.

In the context of the present disclosure, the term "atmospheric pressure" is not limited to an exact value for atmospheric pressure such as 1 atmosphere (760 Torr) at sea level. Instead, the term "atmospheric pressure" also generally encompasses any pressure that is substantially at (i.e., about, approximately, or near) atmospheric pressure. Accordingly, "atmospheric pressure" generally encompasses a range of pressures from about 100 Torr to about 7,000 Torr (or about 0.1 atm to about 10 atm). In addition, implementations of ionization apparatus and methods disclosed herein are not limited to operation at atmospheric pressure, but instead generally include ionization at any above-vacuum pressure, i.e., any pressure not normally considered to be a vacuum pressure, as well as pressures significantly higher than atmospheric and near-atmospheric pressure. Accordingly, in the context of the present disclosure, the term "above-vacuum pressure" generally encompasses any pressure within a range of about 10 Torr (or about 0.01 atm) or greater.

For convenience, the term "mass spectrometer" is used herein in a general, non-limiting sense to refer to a mass analyzing/sorting device and any associated components typically operating within an evacuated or low-pressure space that receives an input of analyte ion-bearing sample material from an API interface or other type of ionization interface operating at above-vacuum pressures.

The subject matter disclosed herein generally relates to systems, apparatus, devices, instruments, processes and methods related to ionization of samples typically for the purpose of sample analysis. Examples of implementations relating to the invention are described in more detail below with reference to FIGS. 1-9. These examples are provided in the context of mass spectrometry (MS), but it will be recognized that the broad aspects of the invention may be applicable to other types of analytical instrumentation. Generally, any process in which the production of ions is desired, including the use of analytical instruments other than mass spectrometers, may fall within the scope of this disclosure.

Figure 1:
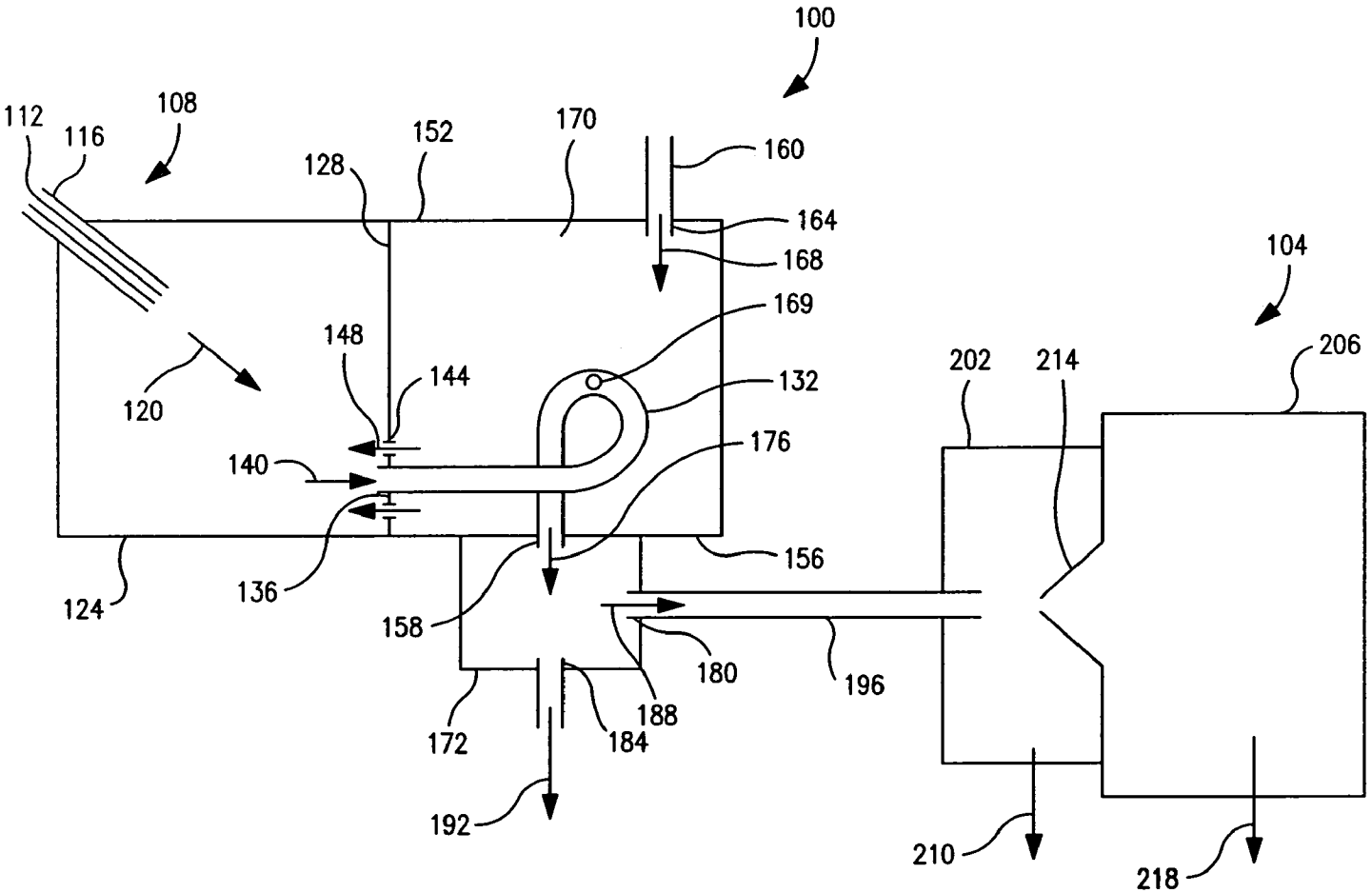
FIG. 1 is a schematic view of an example of an ionization apparatus according to one implementation.

FIG. 1 is a schematic view of an example of an ionization apparatus or system 100 according to one implementation. The ionization apparatus 100 may, for example, be operatively associated with a mass spectrometer 104. The ionization apparatus 100 includes a sample ionization device 108 for ionizing a sample. The sample ionization device 108 may be any suitable ionization device such as, but not limited to, an ionization device utilized in conjunction with ESI, APCI, APPI, or AP MALDI as briefly summarized above. It will be noted, however, that in multi-mode implementations the illustrated sample ionization device 108 may represent two or more of the foregoing types of ionization devices provided in the same sample receiving chamber 124 and operated concurrently or sequentially. In practice, the utilization of different types of ionization techniques, such as ESI, APCI, APPI or AP MALDI, may be complementary and thus highly useful. Moreover, while such devices are conventionally associated with atmospheric-pressure ionization (API), implementations of the subject matter taught herein are not limited to operation at atmospheric pressure, as noted above.

Depending on the specific ionization technique being implemented, the sample ionization device 108 may include a conduit (e.g., capillary, needle, small tube, etc.) 112 in which a sample material to be ionized flows and, optionally, a coaxially disposed outer conduit 116 in which an inert nebulizing gas such as nitrogen ($N_2$) flows. Other components, such as a vaporizing device, an electrical or electromagnetic energy input device (e.g., voltage source, counter-electrode, electrospray needle, corona discharge electrode, photon source, laser, etc.), and the like, may be included as needed for implementing a particular ionization technique as understood by persons skilled in the art. For simplicity, such other components are not illustrated. In all such ionization techniques, sample material typically is emitted from the sample ionization device 108 as a stream of gas and vapor components (e.g., jet, spray, electrospray, aerosol, etc.), which for convenience will be referred to as a sample droplet stream or ionized sample material 120 regardless of form or composition.

For purposes of the present disclosure, no specific limitations are placed on the composition of the sample material, the manner in which the sample material is provided to the sample ionization device 108, or fluid dynamic parameters such as flow rate, pressure, viscosity, and the like. In a typical implementation, the sample material provided to the sample ionization device 108 is predominantly a fluid but in other implementations may be a solid or a multi-phase mixture. In many implementations involving API, the fluid is predominantly in a liquid phase. For example, the sample material may be a solution in which analyte components are initially dissolved in one or more solvents or carried by other types of components. In addition to solvents, other auxiliary components (that is, components for which analysis is not necessary but enhanced) may be present, such as excipients, buffers, additives, dopants, reagents, or the like. As another example, the sample material may be the eluent from a chromatographic, electrophoretic or other analytical separation process, in which case the sample material may be a matrix composed of analyte and mobile-phase components. Depending on the location of a given portion of sample material in the ionization apparatus 100 or the procedural stage at which ionization is occurring, the sample material may comprise primarily ions alone or ions in combination with other components such as charged and/or neutral droplets, vapor, gas, or the like. Accordingly, the term "sample material" as used herein is not limited by any particular phase, form, or composition. Moreover, the sample material flowing through the sample ionization device 108 may originate from any suitable source or sample inlet system (not shown), such as a batch volume, a sample probe, or an upstream instrument or process. For example, the inlet into the sample ionization device 108 may comprise or communicate with the outlet of an analytical separation system or device such as a chromatographic column. As other examples, the sample material may be supplied to the sample ionization device 108 from a liquid handling system, a reservoir, a syringe or other sample moving device, or a dissolution testing system. The flow of the sample material to or through the sample ionization device 108 may be induced by any means, such as pumping, moving boundary, pressure differential, capillary action, or electrically-related techniques.

As illustrated in FIG. 1, the sample droplet stream 120 flows into the interior of a sample receiving chamber (or ionization chamber) 124. The sample receiving chamber 124 may be defined by any suitable housing or enclosing structure, including a wall or other boundary or structure 128. The sample receiving chamber 124 provides an enclosed region in which full or partial ionization of a sample material may occur as part of a desired analytical procedure such as detecting analyte ions in mass spectrometry. At least one wall or portion of a wall of the sample receiving chamber 124, for example the boundary 128, includes an opening for receiving a sample interface conduit 132 having an inlet 136. The sample conduit inlet 136 serves as a sample outlet orifice of the sample receiving chamber 124, whereby sample material exits the sample receiving chamber 124 and enters the sample conduit 132 via the inlet 136 generally in the direction indicated by a flow arrow 140. The sample conduit inlet 136 may be flush or substantially flush with (or register with) the corresponding opening of the sample receiving chamber 124, or alternatively the inlet end of the sample conduit 132 may extend into the sample receiving chamber 124. In all such cases, the sample conduit inlet 136 may be characterized as being positioned or located at the boundary 128. The same boundary 128 of the sample receiving chamber 124 may also include a drying gas outlet 144 by which drying gas is admitting into the sample receiving chamber 124. The drying gas outlet 144 may be flush or substantially flush with the surface of the boundary 128 facing the sample receiving chamber 124, or alternatively may extend into the sample receiving chamber 124. The drying gas outlet 144 may include one or more drying gas orifices, slits, arcuate slots, or the like located proximate to the sample conduit inlet 136. Accordingly, in the implementation illustrated in FIG. 1, drying gas is introduced into the sample receiving chamber 124 via the drying gas outlet 144 generally in the direction(s) indicated by a flow arrow or arrows 148. At least the initial flow 148 of drying gas may be generally counter to or in reverse to the flow 140 of exiting sample material. However, the initial direction of the flow 148 of drying gas may be in any direction, e.g., the same direction as the flow 148 of sample material. Moreover, drying gas may constitute a component of the exiting flow 140 in combination with the sample material provided in the sample droplet stream 120.

The ionization apparatus 100 may also include an interface or intermediate chamber 152. The interface chamber 152 may be defined by any suitable housing or enclosing structure. One or more walls, boundaries or other structures of the interface chamber 152 may be shared with the sample receiving chamber 124 and thus serve as a partition between the sample receiving chamber 124 and the interface chamber 152, for example the boundary 128 as illustrated in FIG. 1. The boundary 128, as well as other boundaries described in the present disclosure, generally encompass one distinct side of a given chamber, and thus may include not only a single planar wall or surface but also other structural features associated with that wall or surface. In the example illustrated in FIG. 1, the interface chamber 152 provides an enclosed interior through which most or all of the length of the sample conduit 132 runs. At least one wall or portion of a wall of the interface chamber 152, for example a boundary 156, includes an opening for receiving an outlet 158 of the sample conduit 132.

The sample conduit 132 serves as a distinct interface or stage intermediately positioned between the sample receiving chamber 124 and the low-pressure/vacuum regions of the mass spectrometer 104. In some implementations, the sample conduit 132 includes at least one nonlinear section (structure, feature, etc.) such that the internal flow path defined by the sample conduit 132 includes at least one turn. That is, when considering at least two given points along the length of the sample conduit 132, the center axis of the internal cross-section of the sample conduit 132 at the one point will be oriented at a non-zero angle relative to the center axis of the internal cross-section at the other point. In this manner, at one or more points along the length of the sample conduit 132, the center axis of the internal cross-section encounters and passes through the inside surface of the sample conduit 132, such that liquid droplets or other heavier components of the sample material flowing along this axis will impinge on the inside surface. The nonlinear section(s) may be provided to increase the energy exchange between the sample conduit wall, the drying gas, and the sample material, resulting in desolvation of sample cluster ions and evaporation of liquid droplets.

For example, the sample conduit 132 may include one or more bends or turns between the inlet 136 and outlet 158, thereby establishing a non-linear (e.g., single-bend, multi-bend, convoluted, serpentine, etc.) flow path of extended length along which the sample material and drying gas are transported from the sample receiving chamber 124 toward the mass spectrometer 104. The turn or bend in the sample conduit 132 may range from being sharp or abrupt to being curved with a relatively large radius of curvature, as appropriate for the flow rate through the sample conduit 132, the pressure in the sample conduit 132, and the expected composition of the sample material. In the example illustrated in FIG. 1, a significant portion of the length of the sample conduit 132 turns along a loop, spiral, or helix. This type of nonlinear feature results in a curved flow path with many centerline axes angled relative to one another, thus providing many opportunities for sample components to encounter the inner wall of the sample conduit 132. In other examples, the sample conduit 132 may include an elbow or L-shaped section, a U-shaped section, etc.

The ionization apparatus 100 also includes a drying gas source 160 for supplying a suitable drying gas to the ionization apparatus 100. The drying gas may be, for example, nitrogen ($N_2$). The drying gas source 160 includes one or more drying gas source inlets 164 by which one or more flows 168 of drying gas are introduced into the ionization apparatus 100. The drying gas source 160 may also include a means or device (not specifically shown) for heating the drying gas prior to its introduction into the ionization apparatus 100, as well as a means for flowing the drying gas and regulating the flow rate or pressure of the drying gas such as a pump and associated components. One of the boundaries of the interface chamber 152, for example the boundary 170 as illustrated in FIG. 1, may include an opening, fitting, feed-through or the like for accommodating a conduit of the drying gas source 160 that terminates at the drying gas inlet 164, in which case the drying gas source 160 communicates with the interface chamber 152. The drying gas source outlet 164 may be flush or substantially flush with the corresponding opening of the boundary 170 of the interface chamber 152, or may extend into the interface chamber 152.

Accordingly, in the example illustrated in FIG. 1, the ionization apparatus 100 is configured to establish a flow path for the heated drying gas into the interface chamber 152 via one or more drying gas source inlets 164 as indicated by the flow arrow 168, through the interior of the interface chamber 152, and from the interface chamber 152 into the sample receiving chamber 124 via a drying gas outlet 144 (e.g., one or more drying gas orifices) as indicated by the flow arrow(s) 148. The flow of drying gas through the interface chamber 152 is physically separate from the flow of sample material and drying gas through the sample conduit 132. However, as the drying gas travels through the interior of interface chamber 152, the drying gas may flow around and in thermal contact with the outer surface of the sample conduit 132, thereby heating the sample material flowing through the sample conduit 132 as well as maintaining an elevated temperature of the drying gas flowing with the sample material through the sample conduit 132. The sample conduit 132, including the sample conduit inlet 136 and outlet 158, may be positioned in the interface chamber 152 relative to the drying gas source inlet 164 and drying gas outlet 144 as needed to heat the sample material flowing through the sample conduit 132. Likewise, the drying gas source inlet 164, including the angle or orientation of the initial direction of the drying gas flow 168, and drying gas outlet 144 may be positioned relative to the sample conduit 132 as needed to effectively heat the sample material flowing through the sample conduit 132. With the foregoing considerations in mind, it will be understood that the relative positions and orientations of the drying gas source inlet 164, the drying gas outlet 144, and the sample conduit 132 have been illustrated in FIG. 1 arbitrarily and by way of example only.

If needed or desired, additional components (not shown) may be utilized to optimize the transfer of thermal energy from the drying gas introduced into the interface chamber 152 and the sample conduit 132. For example, the drying gas source 160 may include a plenum or manifold that routes the drying gas to two or more appropriately positioned drying gas source inlets 164. As another example, plenums, baffles or other structures may be provided in the interface chamber 152 to modify the drying gas flow path in the interface chamber 152 in a desired manner.

As an alternative or in addition to utilizing the drying gas to heat the sample conduit 132, other means for heating the sample conduit 132 may be employed. For example, resistive heating means (not shown) may be employed, such as by running electrical current through a conductive layer or section of the sample conduit 132. In another example, an electrical cartridge may be employed to heat the sample conduit 132. The use of means other than the drying gas to heat the sample conduit 132 may be desirable for independently controlling the heating of the sample conduit 132 and the flow of the drying gas.

As an alternative or in addition to the use of one or more drying gas outlets 144 to allow drying gas to be admitted into the sample conduit 132 at the sample conduit inlet 136, one or more apertures 169 may be formed through the wall of the sample conduit 132 at more or more points along the length of the sample conduit 132 for the same purpose of establishing contact between the heated drying gas and the sample material flowing through the sample conduit 132. As an example, FIG. 1 illustrates a drying gas inlet aperture 169 located at or near the middle-length of the sample conduit 132. The pressure differential between the interface chamber 152 and the interior of the sample conduit 132 is sufficient to draw the drying gas into the sample conduit 132 at the desired location along its length. The size of the aperture 169 and/or the number of apertures 169 provided may be selected so as to attain the desired flow characteristics of the drying gas into the sample conduit 132.

The ionization apparatus 100 may also include an ion extraction or exit chamber 172. The ion extraction chamber 172 may be defined by any suitable housing or enclosing structure. One or more walls, boundaries or other structures of the interface chamber 152 may be shared with other chambers or regions of the ionization apparatus 100. For example, the boundary 156 illustrated in FIG. 1 may serve as a partition or common side between the interface chamber 152 and the ion extraction chamber 172. As noted above, this boundary 156 may include an opening for receiving the sample conduit outlet 158. The sample conduit outlet 158 may be flush or substantially flush with this opening, or the outlet end of the sample conduit 152 may extend into the ion extraction chamber 172. The ion extraction chamber 172 provides an enclosed interior into which sample material flows from the sample conduit outlet 158, as generally indicated by a flow arrow 176, in preparation for separation of analyte ions from non-analytical material and introduction of the analyte ions into the mass spectrometer 104. The ion extraction chamber 172 also provides openings for accommodating a sampling orifice 180 for receiving ions and an exhaust port 184 for receiving non-analytical material.

Unlike conventional ionization interfaces that are limited to operating at or close to atmospheric pressure, the interior of the sample receiving chamber 124 according to implementations presently disclosed may be at atmospheric (or ambient) pressure, near atmospheric pressure, or significantly above or below atmospheric pressure. Generally, the pressure in the sample receiving chamber 124 may range from 100 Torr to 15,200 Torr, or 0.013 to 20 atmospheres, and should be higher than the pressure in the ion extraction chamber 172. The drying gas, or both the drying gas and nebulizing gas such as may be provided by the sample ionizing device 108, may be utilized to pressurize the sample receiving chamber 124 to a desired background pressure for ionization. Pressurizing the sample receiving chamber 124 to an above-atmospheric pressure may assist in driving both drying gas and sample material into the sample conduit 132.

The pressure in the interface chamber 152 may generally be any value. However, when the interface chamber 152 is utilized to direct a flow of drying gas to heat the sample conduit 132, the pressure in the interface chamber 152 may largely be dictated by the drying gas introduced from the drying gas source outlet 164, in which case the pressure in the interface chamber 152 should be such as to facilitate or at least not impair this thermal energy-transferring function of the drying gas. Generally, the pressure in the interface chamber 152 may be at ambient or atmospheric pressure, may be the same or about the same as the pressure in the sample receiving chamber 124, or may be higher than the pressure in the sample receiving chamber 124, for example about 5-40 Torr above the pressure in the sample receiving chamber 124.

The pressure in the ion extraction chamber 172 may be any pressure suitable for extracting ions from the incoming sample flow 176 as well for maintaining a pressure differential between the sample receiving chamber 124 and the ion extraction chamber 172 so as to drive sample material and drying gas through the sample conduit 132. In one example, the pressure in the ion extraction chamber 172 is on the order of a hundred or hundreds of Torr, a further example being about 200 Torr. In other examples, the pressure in the ion extraction chamber 172 may range up to an above-atmospheric pressure. It follows that the pressure in the interface itself, i.e., the sample conduit 132, is lower than the pressure in the sample receiving chamber 124. It will be noted, however, that the means by which sample material exits the sample receiving chamber 124 is the sample conduit 132 taught in the present disclosure, whereas in conventional ionization apparatus the exit means is the sampling orifice, i.e., the capillary or skimmer that leads directly into the low-pressure/vacuum pump stages of a mass spectrometer.

The pressure in the sample conduit 132, including in the region of the inlet 136, is higher than the pressure of a conventionally positioned sampling orifice. This higher pressure and longer time of contact between the sample material and the drying gas result in more efficient transfer of thermal energy between the heated drying gas and the solvent droplets and clustered ions of the sample material produced from the sample ionizing device 108.

In operation, sample material is directed toward the sample conduit inlet 136 in the sample droplet stream 120 emitted from the sample ionizing device 108. In addition, the charged components of the sample droplet stream 120 may be attracted toward the sample conduit inlet 136 by applying a suitably directed electrical field in the sample receiving chamber 124. For example, a potential difference may be established between a component of the sample ionizing device 108 such as an electrospray needle, a corona discharge electrode, a photon source or other conductive element, and the sample conduit inlet 136 or other conductive element proximate to the sample conduit inlet 136. Sample material is drawn into the sample conduit inlet 136 as a result of the pressure difference between the sample receiving chamber 124 and the sample conduit 132. The flow 140 of sample material into the sample conduit inlet 136 may be assisted through application of an electrical field as noted above or an additional electrical field. In addition, if the sample receiving chamber 124 is pressurized to a relatively high level above atmospheric pressure, such pressurization may act to push sample material into the sample conduit inlet 136.

The sample material flows into the sample conduit inlet 136. In implementations that provide the drying gas outlet(s) 144 in the illustrated location, the sample material initially flows against the counter-flow 148 of drying gas. The drying gas thus contacts the sample material in the region in front of the sample conduit inlet 136, where the drying gas assists in evaporating liquid droplets and/or sweeping solvent droplets away from the sample conduit inlet 136. Liquid droplets not evaporated or swept away as a result of this initial encounter with the drying gas then enter the sample conduit inlet 136 along with ions, charged clusters and other components of the sample material. Unlike conventional techniques, drying gas is also deliberately permitted to exit the sample receiving chamber 124 with the sample material and/or enter the sample conduit 132 via the aperture(s) 169 as described previously. As noted above, in conventional ionization apparatus, the exit for sample material from an ionization chamber is the sampling orifice (e.g., a capillary or skimmer) that leads directly into a mass spectrometer. In conventional techniques, the ideal process would be for only analyte ions to exit the sample receiving chamber 124. These conventional techniques thus seek to maximize the evaporation and sweeping away of liquid droplets in the sample receiving chamber 124 and minimize entrainment of drying gas with the flow of sample material exiting the sample recovering chamber 124. By contrast, in the implementation illustrated in FIG. 1, the exit for sample material from the sample receiving chamber 124 is the inlet 136 into the sample conduit 132, which provides an interface formed so as to significantly increase the degree of contact between the heated drying gas and the sample material as well as improve other performance criteria such as discussed below.

One or more features of the ionization apparatus 100 according to implementations such as the above-described example may be implemented to provide improved desolvation of sample ions, evaporation of droplets, and separation of sample ions from liquid droplets and matrix background components, thus enabling acquisition of a higher ion signal, lower chemical background, higher signal-to-noise ratio (S/N), higher sensitivity, and less contamination of the downstream analytical instrument such as a mass spectrometer 104. The interface provided by the ionization apparatus 100, in particular the sample conduit 132, is operated at an elevated temperature by means such as described above, thus enhancing desolvation of the sample ions. Additionally, the sample ions, droplets and other components introduced into the sample receiving chamber 124 by the sample ionization device 108 are entrained into the sample conduit 132 together with the drying gas emanating from the drying gas outlet 144. Collisions between these components within the interior of the sample conduit 152 further enhance desolvation of the sample ions. Moreover, the drying gas remains in thermal contact with the droplets of the sample material for a longer time as compared with conventional ionization interfaces, resulting in more thermal energy being transferred to the droplets and thus enhancing evaporation of the droplets. By the time the sample material reaches the ion extraction chamber 172 as indicated by the flow 176, most or all of the liquid-phase components have evaporated and the clustered and solvated ions have been liberated. Thermal energy transfer is also improved because the ionization apparatus 100 is configured to enable the interface to be operated at a relatively higher pressure as compared with conventional ionization interfaces. As indicated above, depending on path length, the interface may be operated from a couple of tens of Torr to several atmospheres. Also, the nonlinear path of sample material as established by a nonlinear (e.g., bent, spiral, convoluted, etc.) sample conduit 132 provides more collisions between sample ions and drying gas and forces larger liquid droplets to impinge on the inside surface of the sample conduit 132 due to momentum, centrifugal force, or the like. Each bent or turned section of the sample conduit 132 may have any angle and radius of curvature suitable for this purpose.

One indication or measurement of the total number of collisions occurring in the sample conduit 132 is to consider the product of the pressure within the sample conduit 132 and the length of the sample conduit 132 (Torr×cm, or Torr–cm). In one example, this pressure-length product ranges from 50 Torr–cm or greater. In another example, the pressure-length product ranges from 100 to 10,000 Torr–cm. In another example, the pressure-length product ranges from 200 to 2,000 Torr–cm. Depending on the length of the sample conduit 132, the pressure in the sample conduit 132 may range from 20 Torr to 7,000 Torr. In another example, the pressure in the sample conduit 132 ranges from about 100 Torr to about 7,000 Torr. In another example, the pressure in the sample conduit 132 is about 200 Torr and the length of the sample conduit 132 is about 10 cm, giving a pressure-length product of 2,000 Torr–cm in this particular example. It will be noted that the pressure within the sample conduit 132 may be taken to be an average value, although it will be further noted that in typical implementations the change in pressure through the length of the sample conduit 132 is minimal. In many implementations, the pressure in the sample conduit 132 depends primarily on pumping speed.

Continuing with the present example of operation, after the sample material reaches the ion extraction chamber 172, desolvated ions are extracted from the incoming flow 176 and enter the sampling orifice 180 as generally indicated by an arrow 188, while neutral components and other non-analytical material are directed into the exhaust port 184 as generally indicated by an arrow 192. For this purpose, the exhaust port 184 may communicate with a suitable vacuum source such as a pump (not shown). In other implementations described below, the exhaust port may serve as a vent to an atmospheric environment. In the implementation illustrated in FIG. 1, the axis of the sample conduit outlet 158 is generally aligned with the axis of the exhaust port 184 and the sampling orifice 180 is oriented in off-axis relation to the sample conduit outlet 158. In other implementations described below, the axis of the sample conduit outlet 158 is generally aligned with the axis of the sampling orifice 180 and the exhaust port 184 is oriented in off-axis relation to the sample conduit outlet 158. One or more voltage sources may be connected in electrical communication with conductive elements in the ion extraction region, such as the sample conduit 152, the sampling orifice 180, and one or more walls of the ion extraction chamber 172, as needed to assist in extracting the desired analyte ions from the incoming flow 176. In many implementations, however, the pressure differential between the ion extraction chamber 172 and the low-pressure or evacuated side of the sampling orifice 180 provides an adequate driving force for directing ions into the sampling orifice 180. As further discussed below, appropriate voltages may applied so as to slow or retard the flow of ions flowing into the extraction chamber 172.

The sampling orifice 180 serves as an ion inlet leading to the lower pressure and evacuated regions of the mass spectrometer 104. Depending on the length of the ion passage into the mass spectrometer 104, the sampling orifice 180 may constitute the inlet of a small-bore tube or capillary 196 such as illustrated by example in FIG. 1. Continuing with this example, the mass spectrometer 104 may include one or more intermediate chambers or pump stages 202 and a mass analyzing stage 206. The pump stage 202 illustrated in FIG. 1 may be pumped down by a suitable pump, as represented by an arrow 210, to a suitable sub-atmospheric pressure such as, for example, about 1 Torr. Ions transported by the capillary 196 flow through the pump stage 202 and into the mass analyzing stage 206 via an orifice such as may be provided in a skimmer plate 214. The mass analyzing stage 206 may be pumped down by a suitable pump, as represented by an arrow 218, to a suitable low vacuum pressure such as, for example, about 1 or 2 mTorr. The mass analyzing stage 206 may include various components associated with implementing mass spectrometry as appreciated by persons skilled in the art, such as ion guides and mass sorting devices. The pressure within the mass sorting device may be further reduced to a very low vacuum pressure such as, for example, $10^{-5}$ Torr or less. Various mass spectrometric techniques are known. The implementations taught by the present disclosure do not require any particular type of mass spectrometer 104.

Figure 2:
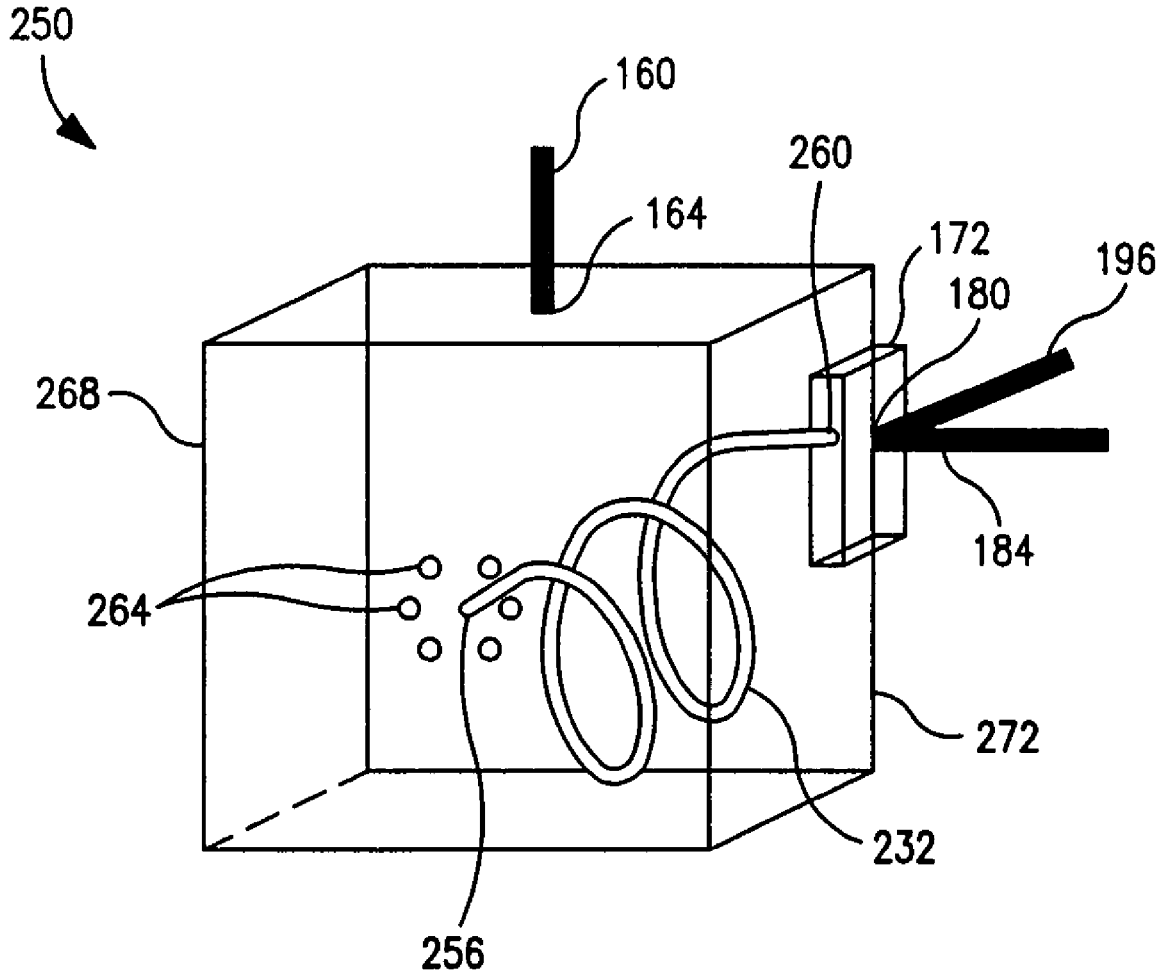
FIG. 2 is a schematic view of an example of an ionization apparatus according to another implementation.

FIG. 2 is a schematic view of another example of an interface structure of an ionization apparatus 250. This implementation includes a coiled or helical sample conduit 232 that provides several turns in the flow path of the sample material. The sample conduit 232 includes an inlet 256 and an outlet 260. The sample conduit inlet 256 is surrounded by several circumferentially spaced drying gas orifices 264 formed in a wall 268 of the interface chamber. This wall 268 may constitute a boundary shared with the sample receiving chamber into which the drying gas enters from the drying gas orifices 264. The drying gas orifices 264 are radially spaced from the sample conduit inlet 256 by a small distance, thus enabling the drying gas to perform its conventional evaporating and sweeping functions in the sample receiving chamber as well as become entrained with the sample material into the sample conduit inlet 256. The sample conduit outlet 260 registers with or extends through another wall 272 that adjoins the wall 268 at a common border. Other components illustrated in FIG. 2 may be configured similar to like components described above and illustrated in FIG. 1.

Figure 3:
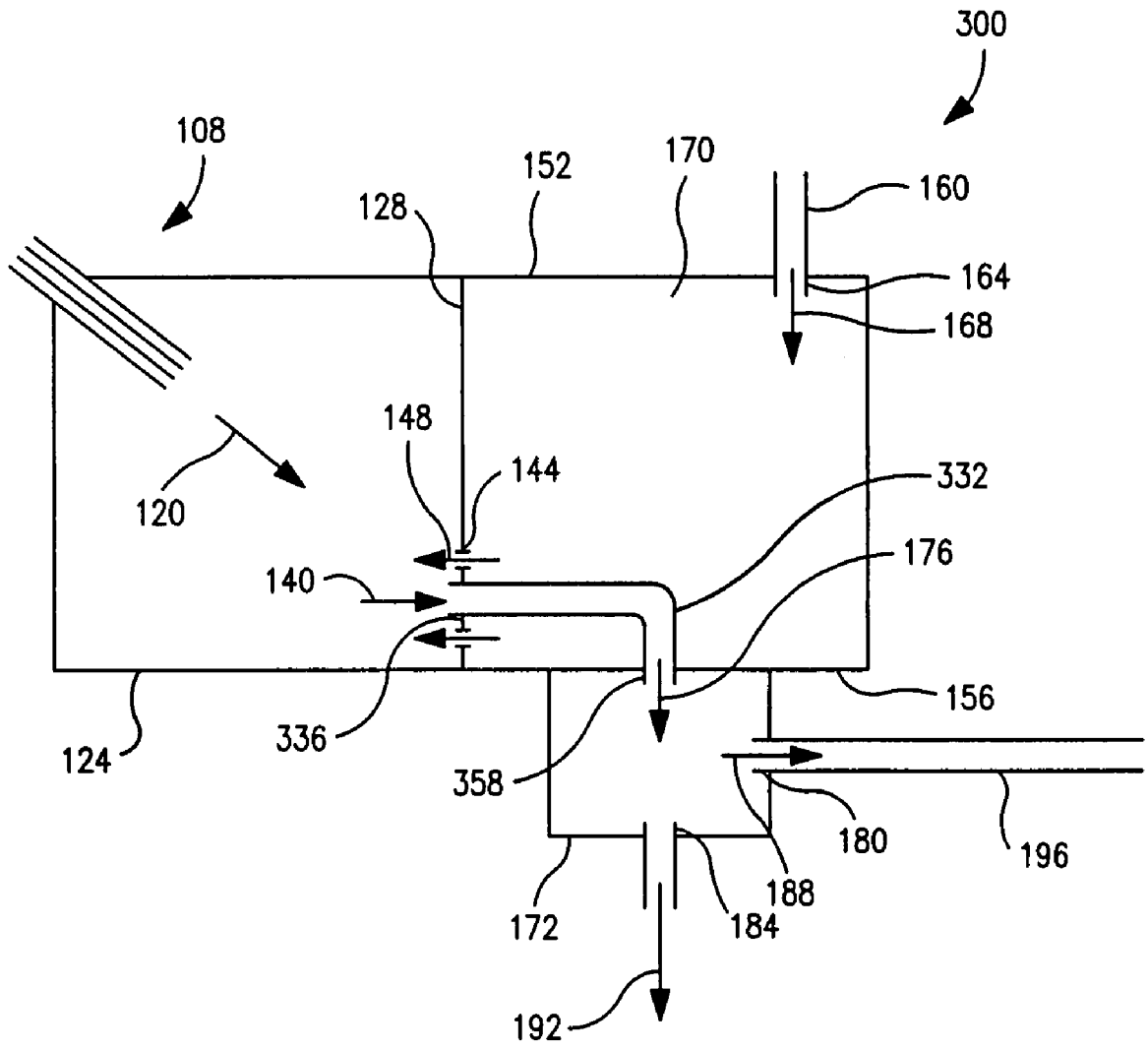
FIG. 3 is a schematic view of an example of an ionization apparatus according to another implementation.

FIG. 3 is a schematic view of another example of an interface structure of an ionization apparatus 300. This implementation includes a sample conduit 332 having an inlet 336 and an outlet 358. The sample conduit 332 includes a single bend or L-shaped feature. The angle of the bend may be 90 degrees or about 90 degrees as illustrated in FIG. 3, or may be any other angle sufficient to provide a nonlinear sample-material flow path in which large droplets may impinge against the inside surface of the sample conduit 332.

Figure 4:
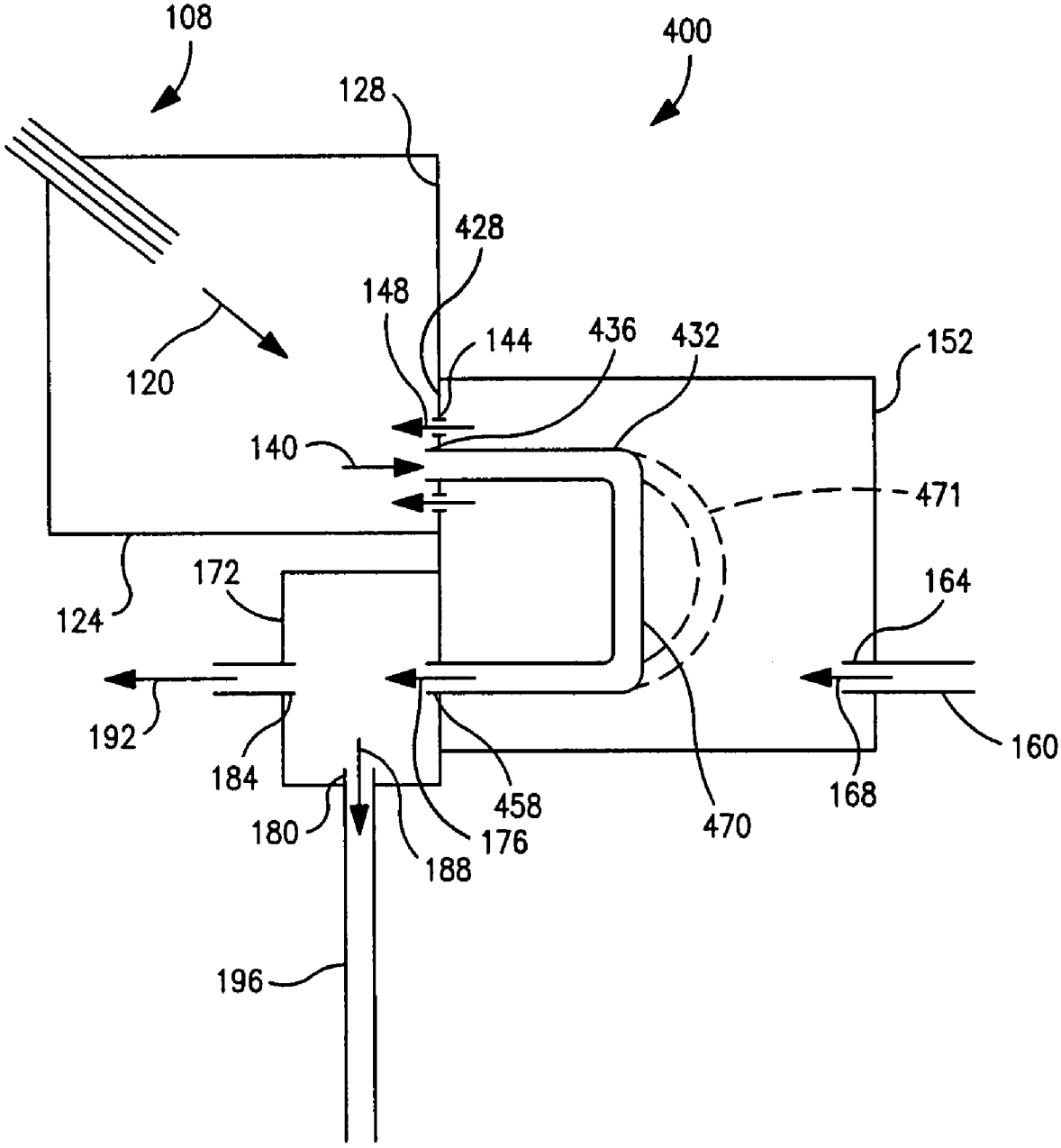
FIG. 4 is a schematic view of an example of an ionization apparatus according to another implementation.

FIG. 4 is a schematic view of another example of an interface structure of an ionization apparatus 400. This implementation includes a sample conduit 432 having an inlet 436 and an outlet 458. The sample conduit 432 establishes a sample material flow path that turns 180 degrees such as by including two bends or L-shaped features, or a U-shaped feature. One boundary or side 428 provides openings for both the inlet end and outlet end of the sample conduit 432. This boundary or side 428 may be shared by not only the sample receiving chamber 124 but also the ion extraction chamber 172. In one example illustrated in FIG. 4, the U-shaped feature includes a straight or substantially straight section 470 between two legs. In another example, also illustrated in FIG. 4, the sample conduit 432 alternatively includes a curved section 471 between the two legs.

Figure 5:
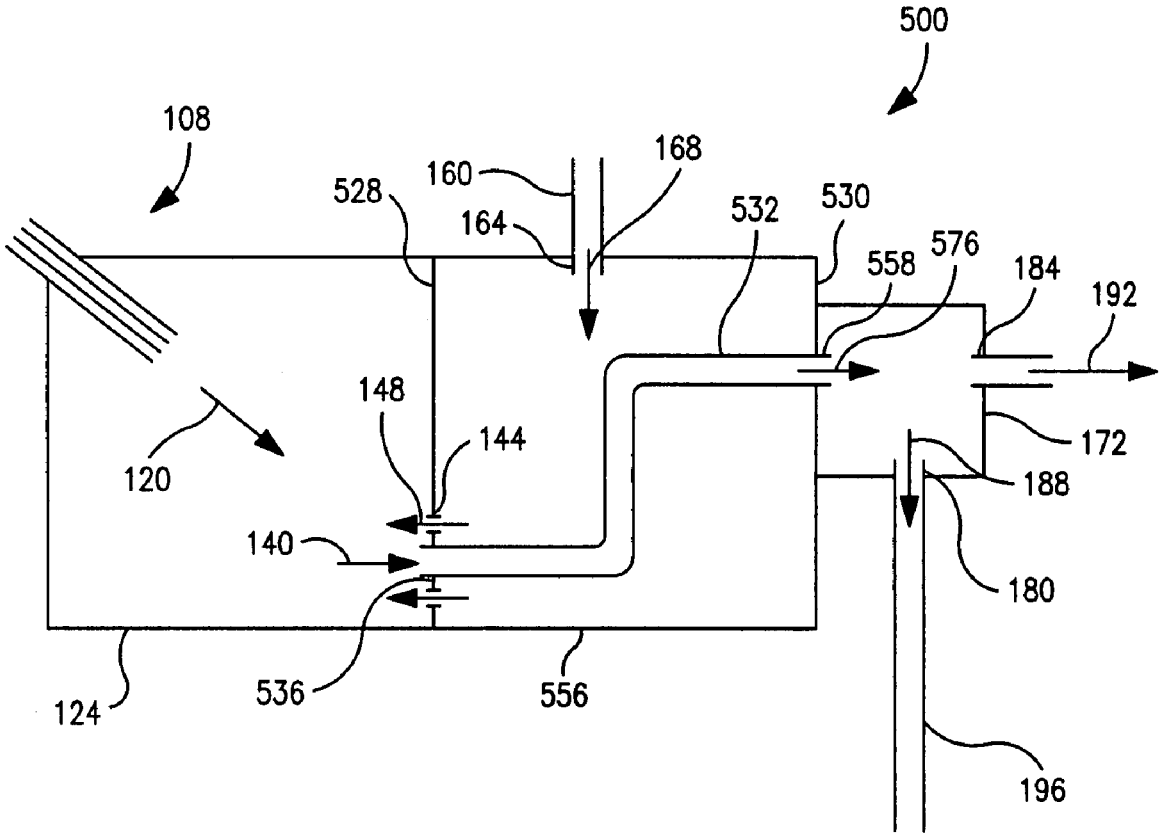
FIG. 5 is a schematic view of an example of an ionization apparatus according to another implementation.

FIG. 5 is a schematic view of another example of an interface structure of an ionization apparatus 500. This implementation includes a sample conduit 532 having an inlet 536 and an outlet 558. The sample conduit 532 includes two or more bends or L-shaped features. One boundary or side 528 provides an opening for the inlet end of the sample conduit 532. Another boundary or side 530 provides an opening for the outlet end of the sample conduit 532. The boundary or side 530 is opposite to the boundary or side 528, or at least is spaced from the boundary or side 528 by an intervening boundary or side 556. In another alternative of the implementation illustrated in FIG. 5, the sample conduit 532 again includes multiple bends but in the form of a coil or helix similar to configuration illustrated in FIG. 2.

Regarding the examples described above and illustrated in FIGS. 2-5, the sample conduits 232, 332, 432 and 532 may include one or more apertures similar to the aperture 169 alternatively or additionally provided with the sample conduit 132 illustrated in FIG. 1. Moreover, the pressure within and length of the sample conduits 232, 332, 432 and 532, and thus the pressure-length product obtained by these implementations, may be as provided above in connection with the implementation corresponding to FIG. 1.

The several implementations of nonlinear sample conduits illustrated in FIGS. 1-5 are given by way of example and not as limitations. The invention encompasses additional implementations for providing a nonlinear sample material flow path in which large droplets may impinge against the inside surface of the sample conduit.

In other implementations, as alternatives to the examples of ionization apparatus such as described above and illustrated in FIGS. 1-5, the drying gas source 160 or at least its outlet 164 may reside directly in the sample receiving chamber 124. In this case, the drying gas source outlet 164 may be positioned at an orientation and proximity to the sample conduit inlet 136 whereby, similar to the above-described implementations, the drying gas interacts with the sample material in the sample receiving chamber 124 and becomes entrained with the sample material into the sample conduit inlet 136. As in the above-described implementations, heat from the drying gas is transferred to the sample material in front of the sample conduit inlet 136 as well as while both the drying gas and sample material travel through the sample conduit 132. In another specific example, the drying gas may be introduced directly into the sample receiving chamber 124 at a desired angle relative to the flow 120 of sample material emitted from the sample ionization device 108, similar to the technique described in U.S. Pat. No. 5,412,208. In the present invention, however, this technique results in the flows of drying gas and sample material intersecting in a region in front of the sample conduit inlet 136. If needed to ensure maintenance of the sample material flowing through the sample conduit 132 at an elevated temperature, a secondary or auxiliary source of heated gas may be provided to introduce heated gas into the interface chamber 152 to direct the auxiliary heated gas into thermal contact with the sample conduit 132. That is, such implementations may include both a drying gas source inlet and an auxiliary heating gas source inlet.

Figure 6:
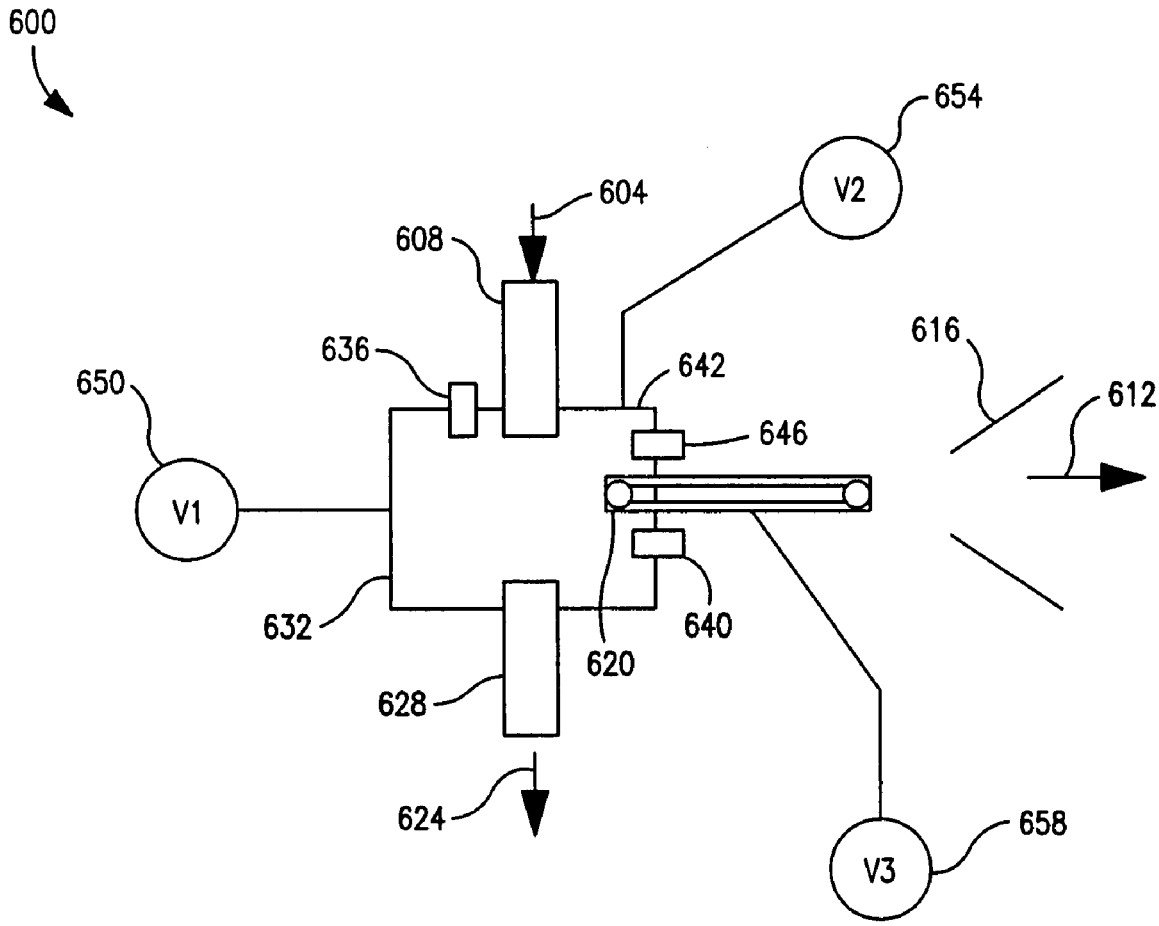
FIG. 6 is a schematic view of an example of an ion extraction chamber according to one implementation.

FIG. 6 is a schematic view of one example of an ion extraction chamber 600 that may be utilized in conjunction with any of the foregoing implementations. As represented by a flow arrow 604, sample material is directed into the ion extraction chamber 600 via a sample conduit 608. As represented by a flow arrow 612, ions are extracted from the sample flow 604 and directed into an entrance 616 to a mass spectrometer via a sampling orifice 620. As represented by a flow arrow 624, neutrals and other non-analytical components of the sample material are directed out of the ion extraction chamber 600 via an exhaust port 628, typically under the influence of a low-pressure or vacuum pump or, in other implementations, under atmospheric conditions.

In some implementations, the ion extraction chamber 600 provides a means for applying a retarding direct-current (DC) electric field across the ion extraction region to increase the efficiency of the process of ion extraction. The resultant force of this applied electrical field is (or may generally be) in the opposite direction to the incoming sample flow 604, thus slowing down the ion flow in the extraction region. As a result, when a steady state is reached, ion density in the ion extraction region will be higher than in other areas. The retarding DC field applied at the ion extraction chamber 600 may be implemented by applying one or more appropriate voltages to one or more conductive surfaces associated with the ion extraction chamber 600. For example, as illustrated in FIG. 6, a conductive wall or wall section 632 of the ion extraction chamber 600 is electrically isolated from other conductive elements by insulating elements 636 and 640. Another conductive wall or wall section 642 of the ion extraction chamber 600 is electrically isolated from the first wall 632 and other conductive elements by insulating elements 636 and 646. The structure defining the sampling orifice 620 is electrically isolated from the walls 632 and 642 by the insulating elements 640 and 646. Voltage sources 650, 654 and 658 or other suitable means are employed to apply voltages V1, V2 and V3 to the first wall 632, second wall 642 and sampling orifice 620, respectively. For positive ions, the voltage V1 is positively biased and is higher in magnitude than the voltage V2 to generate the retarding DC field. The potential difference $\Delta V = V1 - V2$ may range, for example, between approximately 200 V to approximately 2 kV. For extraction of positive ions into the sampling orifice 620, the voltage V3 should be less than the voltage V2 and typically is 0 V or simply represents a ground state.

Figure 7:
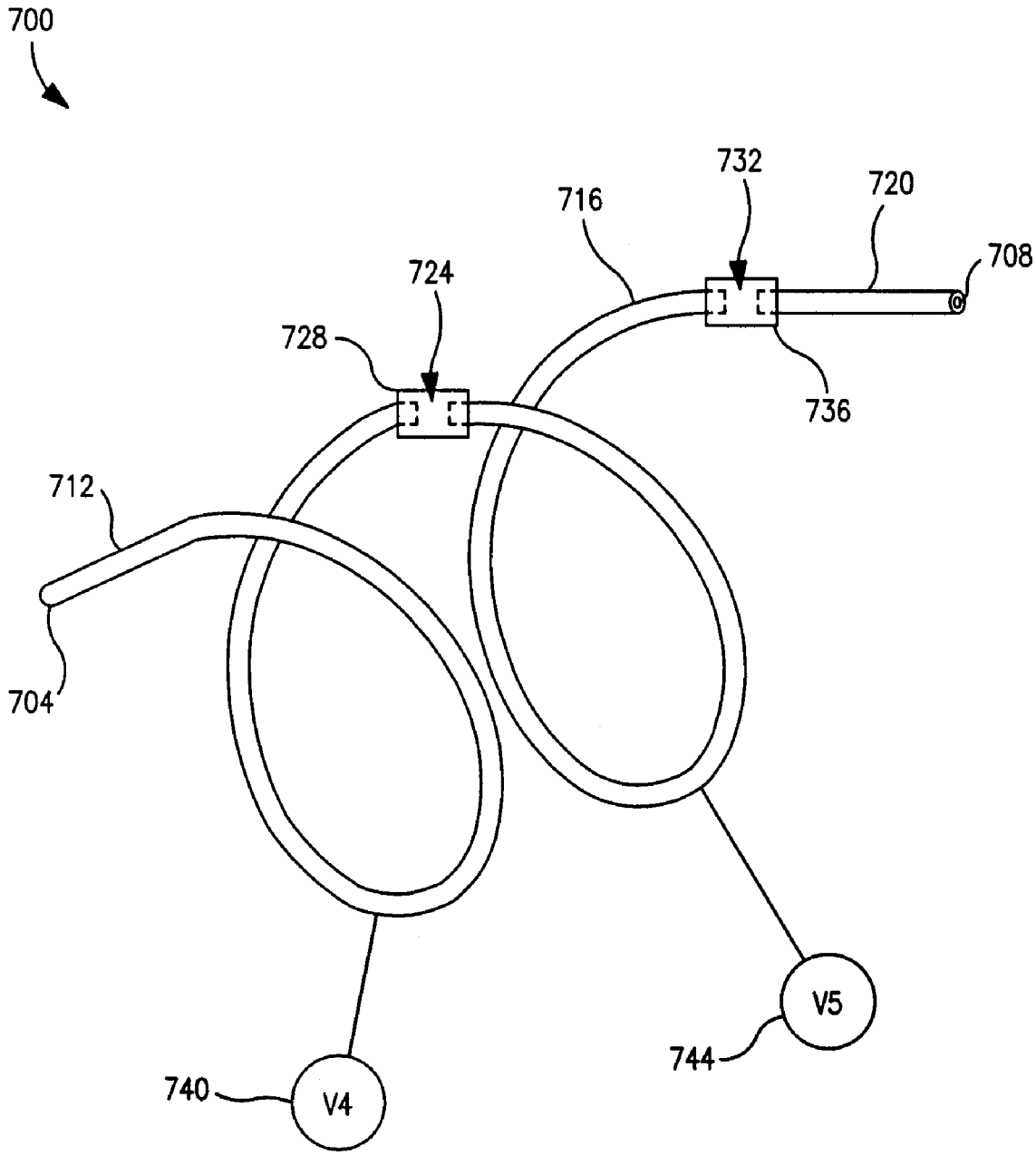
FIG. 7 is a schematic view of an example of a sample conduit according to one implementation.

FIG. 7 is a perspective view of an implementation in which one or more DC or radio-frequency (RF) voltage jumps are applied to a sample conduit 700 to promote collisions between sample ions and drying gas (and/or other neutrals). The sample conduit 700 includes an inlet 704 and an outlet 708. The sample conduit 700 further includes two or more electrically conductive segments, for example three segments 712, 716 and 720. The open ends of adjacent segments are separated by a gap and enclosed by a hollow insulating element. For example, the open ends of adjacent segments 712 and 716 are separated by a gap 724 enclosed by an insulating element 728, and the open ends of adjacent segments 716 and 720 are separated by a gap 732 enclosed by an insulating element 736. Voltage sources or other suitable means are placed in electrical communication with adjacent segments to generate voltage jumps across the gaps. For example, voltage sources 740 and 744 communicate with the adjacent segments 712 and 716 to apply a potential difference V4–V5 across the gap 724, which may be pulsed. The potential difference applied across each gap 724 or 732 may range, for example, between approximately 500 V to approximately 2 kV. The polarity of the applied electric field may be in either direction, regardless of the whether the ions traveling in the sample conduit 700 are positive or negative, or may be alternating. Depending on the polarity of the applied electric field relative to the polarity of the ions, the voltage jumps cause the ions and other charged components of the sample material to accelerate or decelerate relative to the electrically neutral components and the drying gas. The acceleration or deceleration of the ions is relative because the flow rate of the electrically neutral components and the drying gas remains dependent on non-electrical factors, such as the pressure differential between the sample conduit inlet 704 and the sample conduit outlet 708, the expansion due to evaporation of liquid droplets, etc. Thus, as a result of the applied voltage jumps, collisions are promoted between accelerating charged species and drying gas molecules initially in front of the accelerating charged species and/or between decelerating charged species and drying gas molecules initially in back of the decelerating charged species.

Figure 7A:
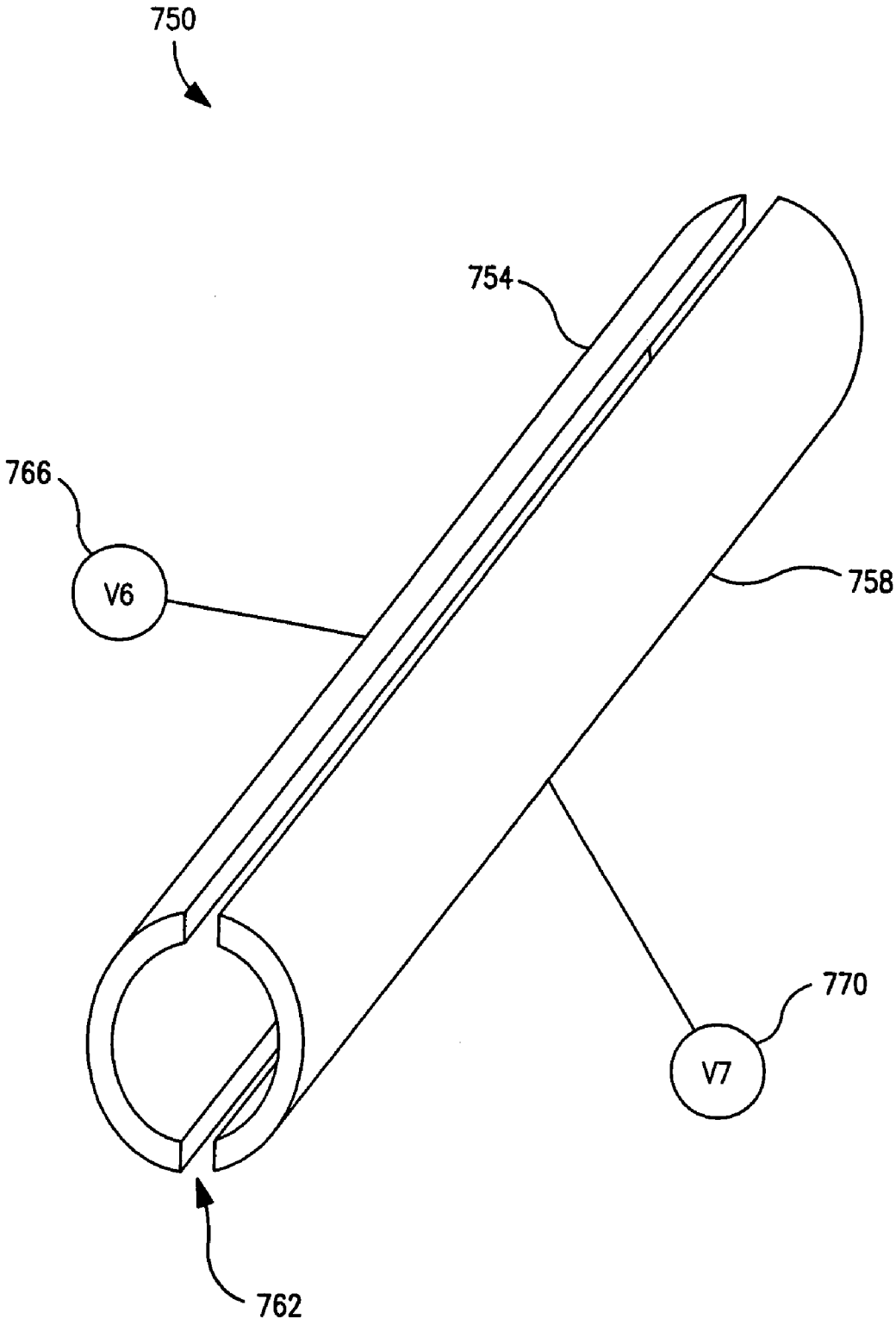
FIG. 7A is a schematic view of an example of a portion of a sample conduit according to another implementation.

Alternatively, FIG. 7A illustrates a length or portion of a sample conduit 750 that has been split or segmented lengthwise into lengthwise segments 754 and 758 separated by a lengthwise or elongated gap 762. The gap 762 in the sample conduit 750 may be enclosed by a hollow insulating element (not shown, but see similar insulating element 728 and 736 in FIG. 7). Respective voltage sources 766 and 770 are placed in electrical communication with these lengthwise segments 754 and 758 to enable application of a potential difference V6–V7 across the gap 762, which may be pulsed. By this configuration an RF voltage jump may be applied transversely to the general direction of flow of sample material through the sample conduit 750, thereby transversely shaking or perturbing the ions and other charged components to promote collisions with the drying gas molecules and/or other neutrals.

Figure 7B:
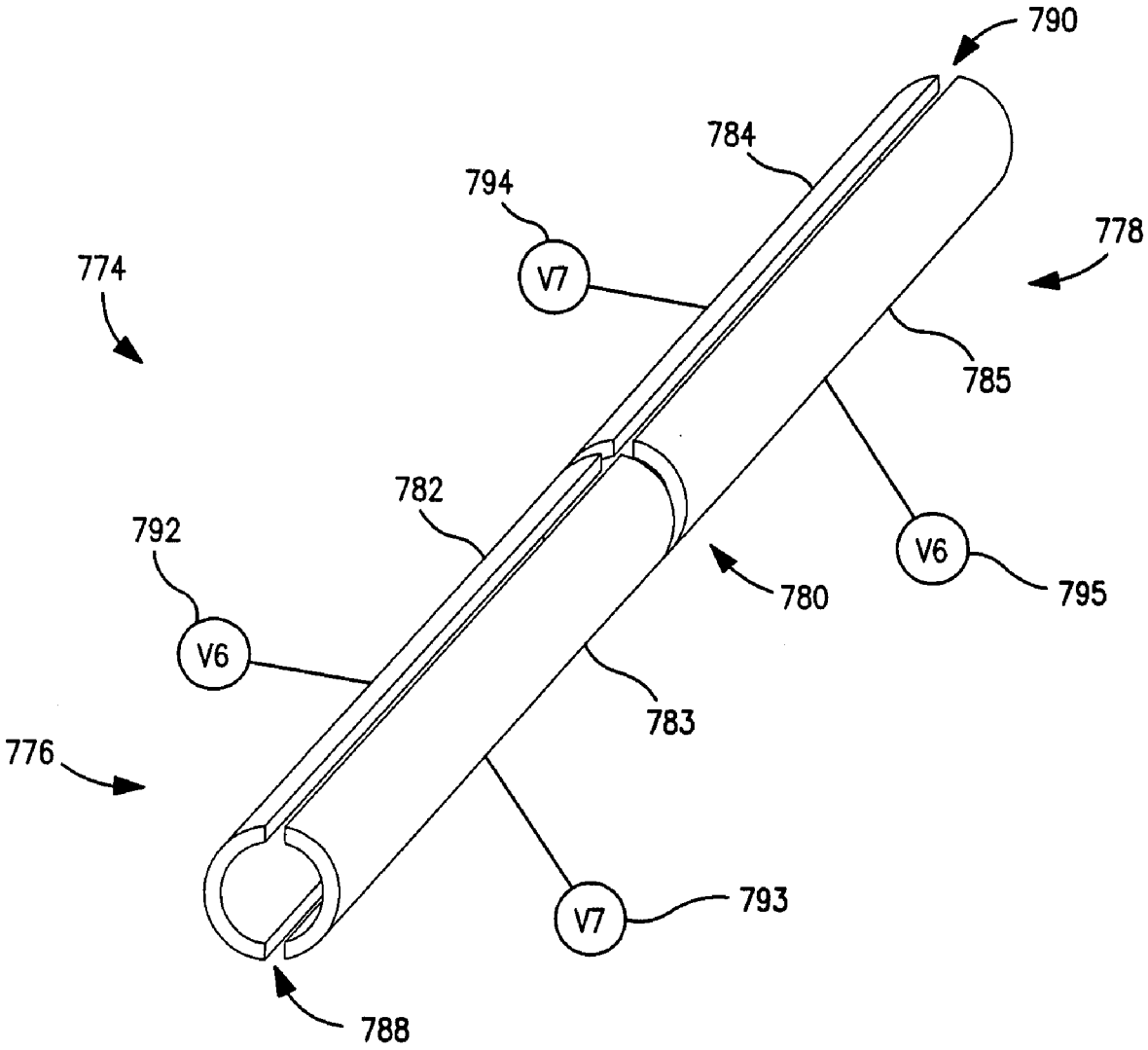
FIG. 7B is a schematic view of an example of a portion of a sample conduit according to another implementation.

As a further alternative, FIG. 7B illustrates a length or portion of a sample conduit 774 that has been split or segmented cross-wise into two (or more) cross-wise segments 776 and 778 separated by a cross-wise gap 780. Each cross-wise segment 776 and 778 is further split or segmented lengthwise into respective lengthwise segments 782, 783, 784 and 785, which are separated by corresponding lengthwise or elongated gaps 788 and 790. The gaps may be enclosed by hollow insulating elements (not shown) as needed. Respective voltage sources 792, 793, 794 and 795 are placed in electrical communication with the lengthwise segments 782, 783, 784 and 785 to enable application of a potential difference V6–V7 across the corresponding lengthwise gaps 788 and 790, which may be pulsed. As illustrated in FIG. 7B, the polarity of the potential difference may be reversed from one cross-wise segment 776 to another adjacent cross-wise segment 778 such that the electrical field applied to the ions alternates as the ions flow through successive cross-wise segments 776 and 778. By this configuration, DC voltage jumps may be applied transversely to the general direction of flow of sample material through the sample conduit 774, thereby transversely shaking or perturbing the ions and other charged components to promote collisions with the drying gas molecules and/or other neutrals. Note also that RF voltage jumps may also be applied in this implementation.

Figure 8:
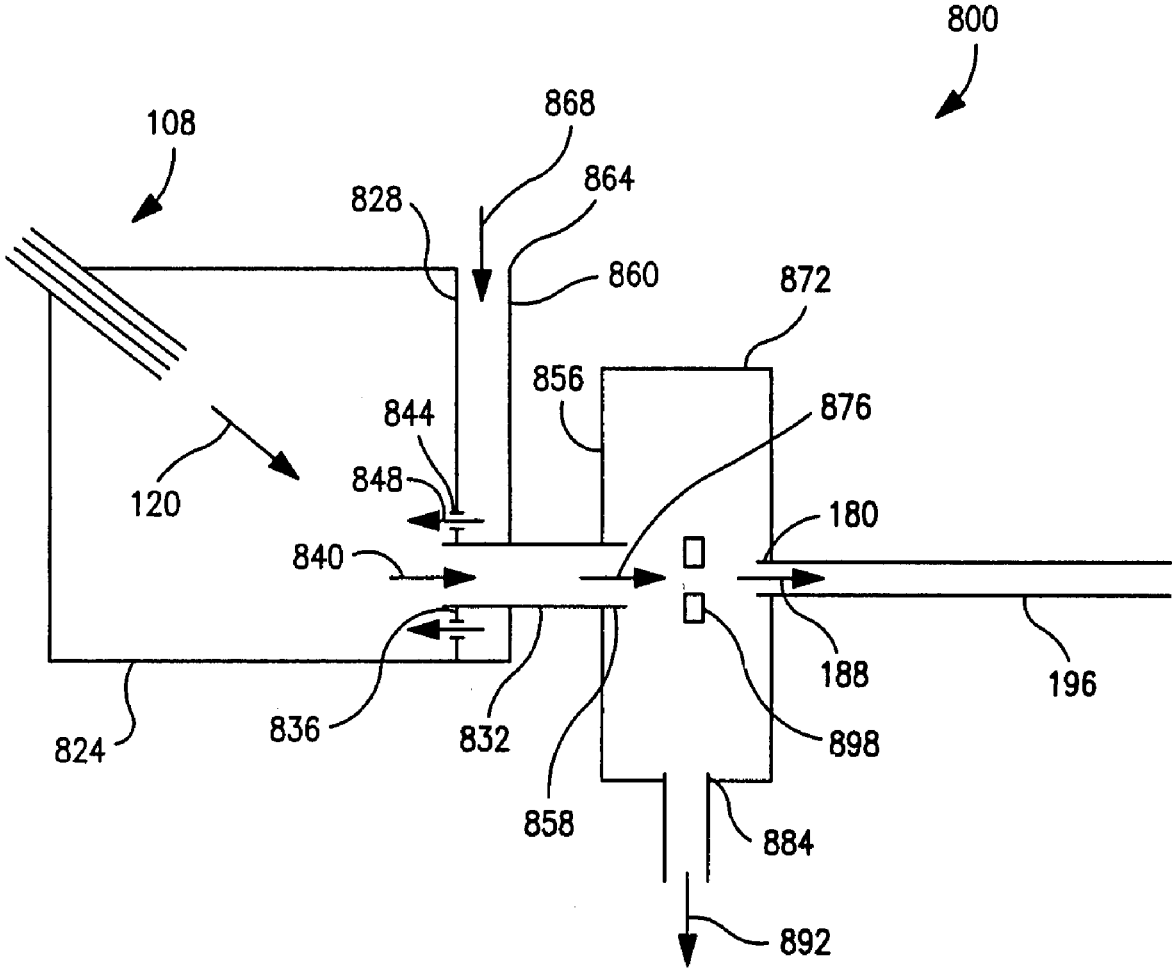
FIG. 8 is a schematic view of an example of an ionization apparatus according to another implementation.

FIG. 8 is a schematic view of another example of an ionization apparatus or system 800. As in the foregoing implementations, the ionization apparatus 800 includes a sample ionization device 108 for ionizing a sample and thus producing a sample droplet stream 120. The sample droplet stream 120 flows into the interior of a sample receiving chamber (or ionization chamber) 824. The sample receiving chamber 824 may be defined by any suitable housing or enclosing structure, including one or more walls or other types of structural boundaries. At least one wall or boundary 828, or portion of such wall or boundary 828, includes an opening for receiving a sample interface conduit 832 having an inlet 836 and an outlet 858. The sample conduit inlet 836 serves as a sample outlet orifice of the sample receiving chamber 824, whereby sample material exits the sample receiving chamber 824 and enters the sample conduit 832 via the inlet 836 generally in the direction indicated by a flow arrow 840. The sample conduit inlet 836 may thus be positioned or located at the boundary 828. That is, the sample conduit inlet 836 may be flush or substantially flush with the corresponding opening provided by the boundary 828, or the inlet end of the sample conduit 832 may extend into the sample receiving chamber 824. The sample conduit outlet 858 is disposed outside the sample receiving chamber 824 at some distance from the boundary 828. The same boundary 828 of the sample receiving chamber 824 may also include a drying gas outlet 844 (e.g., one or more drying gas orifices) located proximate to the sample conduit inlet 836. Accordingly, drying gas is introduced into the sample receiving chamber 824 via the drying gas outlet 844 generally in the direction(s) indicated by a flow arrow or arrows 848. At least the initial flow 848 of drying gas may be generally counter to or in reverse to the flow 840 of exiting sample material. Moreover, drying gas may constitute a significant component of the exiting flow 840 in combination with the sample material. The drying gas is supplied by a suitable drying gas source 860 via an inlet 864. The drying gas source 860 may include a device (not specifically shown) for heating the drying gas. As an alternative or in addition to the use of the drying gas outlet 844, drying gas may be introduced into the sample conduit 832 via one or more apertures (not shown) in the sample conduit 832 as described above in connection with the implementation illustrated in FIG. 1.

The ionization apparatus 800 also includes an ion extraction or exit chamber 872. The ion extraction chamber 872 may be defined by any suitable housing or enclosing structure, which in turn may be defined by one or more walls, boundaries or other structures. One boundary 856 of the ion extraction chamber 872 may include an opening for receiving the sample conduit outlet 858. The sample conduit outlet 858 may thus be positioned or located at the boundary 828. That is, the sample conduit outlet 858 may be flush or substantially flush with the corresponding opening provided by the boundary 856, or the outlet end of the sample conduit 832 may extend into the ion extraction chamber 872. The ion extraction chamber 872 provides an enclosed interior into which sample material flows from the sample conduit outlet 856, as generally indicated by a flow arrow 876, in preparation for separation of analyte ions from non-analytical material and introduction of the analyte ions into the mass spectrometer 104. The ion extraction chamber 872 also provides openings for accommodating a sampling orifice 180 and an exhaust port 884. In the implementation illustrated in FIG. 8, the sample conduit outlet 858 is aligned with the sampling orifice 180, and the exhaust port 884 is oriented at an angle (off-axis) to the sample conduit outlet 858.

The sample conduit 832 serves as a distinct interface or stage intermediately positioned between the sample receiving chamber 124 and the low-pressure/vacuum regions of the mass spectrometer 104 (see, e.g., FIG. 1). In the implementation illustrated in FIG. 8, the internal diameter of the sample conduit 832 is large relative to the diameter of sampling orifices, capillaries and other openings conventionally utilized for transferring sample material from an atmospheric-pressure ionization interface to evacuated regions of a mass spectrometer such as the illustrated sampling orifice 180. The sample conduit 832 may also be relatively short. For example, the internal diameter of the sample conduit 832 may range from about 0.05 cm to about 1 cm, and the length from the sample conduit inlet 836 to the sample conduit outlet 858 may range from about 0.5 cm to about 5 cm. In another example, the length of the sample conduit 832 ranges from about 3 to about 4 cm. In another example, the internal diameter of the sample conduit 832 may range from about 0.5% to about 10% of the length of the sample conduit 832. In another example, the internal diameter of the sample conduit 832 may range from about 100% to about 10,000% of the internal diameter of the sampling orifice 180.

In the implementation illustrated in FIG. 8, the sample conduit 832 remains straight or linear along its length from the sample conduit inlet 836 to the sample conduit outlet 858. In other implementations, similar to those described above, the sample conduit 832 may include at least one nonlinear structure or feature such as one or more bends or turns between the inlet 836 and outlet 858, thereby establishing a non-linear flow path along which the sample material and drying gas are transported from the sample receiving chamber 124 to the mass spectrometer 104. Whether the sample conduit 832 is entirely linear or includes one or more nonlinear features, the sample conduit outlet 858 is aligned or substantially aligned with the sampling orifice 180 in the implementation illustrated in FIG. 8. For instance, the central axis of the sample conduit 858 may be collinear or substantially collinear with the central axis of the sampling orifice 180.

In the implementation illustrated in FIG. 8, the sample receiving chamber 824 may be maintained at an above-atmospheric pressure and the ion extraction chamber 872 may be maintained at an atmospheric or near-atmospheric pressure. The drying gas, or the drying gas in combination with a nebulizing gas such as may be provided by the ionizing device 108, may be utilized to pressurize the sample receiving chamber 824 to the desired above-atmospheric pressure. The exhaust port 884 serves to vent the interior of the ion extraction chamber 872 to an ambient or near-ambient environment as indicated by an arrow 892, thereby maintaining the ion extraction chamber 872 at the atmospheric or near-atmospheric pressure. As an example, the pressure in the sample receiving chamber 824 may range from approximately 1000 Torr to approximately 15,200 Torr, and the pressure in the ion extraction chamber 872 may range from approximately 500 Torr to approximately 1400 Torr. The resulting pressure differential between the inlet and outlet sides of the sample conduit 832 may be utilized to draw sample material from the sample droplet stream 120 and drying gas from the incoming drying gas flow 848 into the sample conduit inlet 836 as indicated by the flow arrow 840. Because in this implementation the ion extraction chamber 872 may operate at or near atmospheric pressure, a large pump at this pump stage is not required, thus reducing costs.

The large-diameter sample conduit 832 functions as a gas restrictor tube that drops the gas pressure to at or near atmospheric pressure at its outlet end. Accordingly, sample flow 840 into the sample conduit inlet 836 may be increased by increasing the pressure in the sample receiving chamber 824 to above atmospheric as noted above. This configuration enables a much larger portion of the sample-bearing gas produced by the ionizing device 108, and particularly the desired analyte ions, to be directed toward the mass spectrometer 104, as compared to conventional ionization apparatus in which a very small-diameter sampling orifice leading to evacuated regions is provided directly at the exit of the sample receiving chamber 824. The ability to sample a much larger portion of the ionized plume produced in the sample receiving chamber 824 may be utilized to increase the sensitivity of the mass spectrometer 104. The relatively high pressure and large volume within the sample conduit 832 enhances the collisions and thermal contact between the drying gas and the sample material. Moreover, the configuration results in a high concentration of sample material at the sample conduit outlet 858, which in turns allows a large portion of the analyte ions to be collected in the sampling orifice 180. The junction of the sample conduit outlet 858, the sampling orifice 180, and the intervening gap in the ion extraction chamber 872 may act as a momentum separator, whereby heavier ion-bearing sample material flows straight into the sampling orifice 180 as indicated by the flow arrow 888 and lighter material such as non-analytical solvent are vented through the exhaust port 884 as indicated by the flow arrow 892. This action of momentum separation may be enhanced by providing a sample conduit 832 that is electrically conductive and applying a voltage to the sample conduit 832, whereby charged components of the sample material accumulate on and near the centerline of the sample conduit 832. As a further means for directing ions into the sampling orifice 180, a conductive element 898 such as an aperture-containing plate, cylinder, or grid may be positioned between the sample conduit outlet 858 and the sampling orifice 180.

Figure 9:
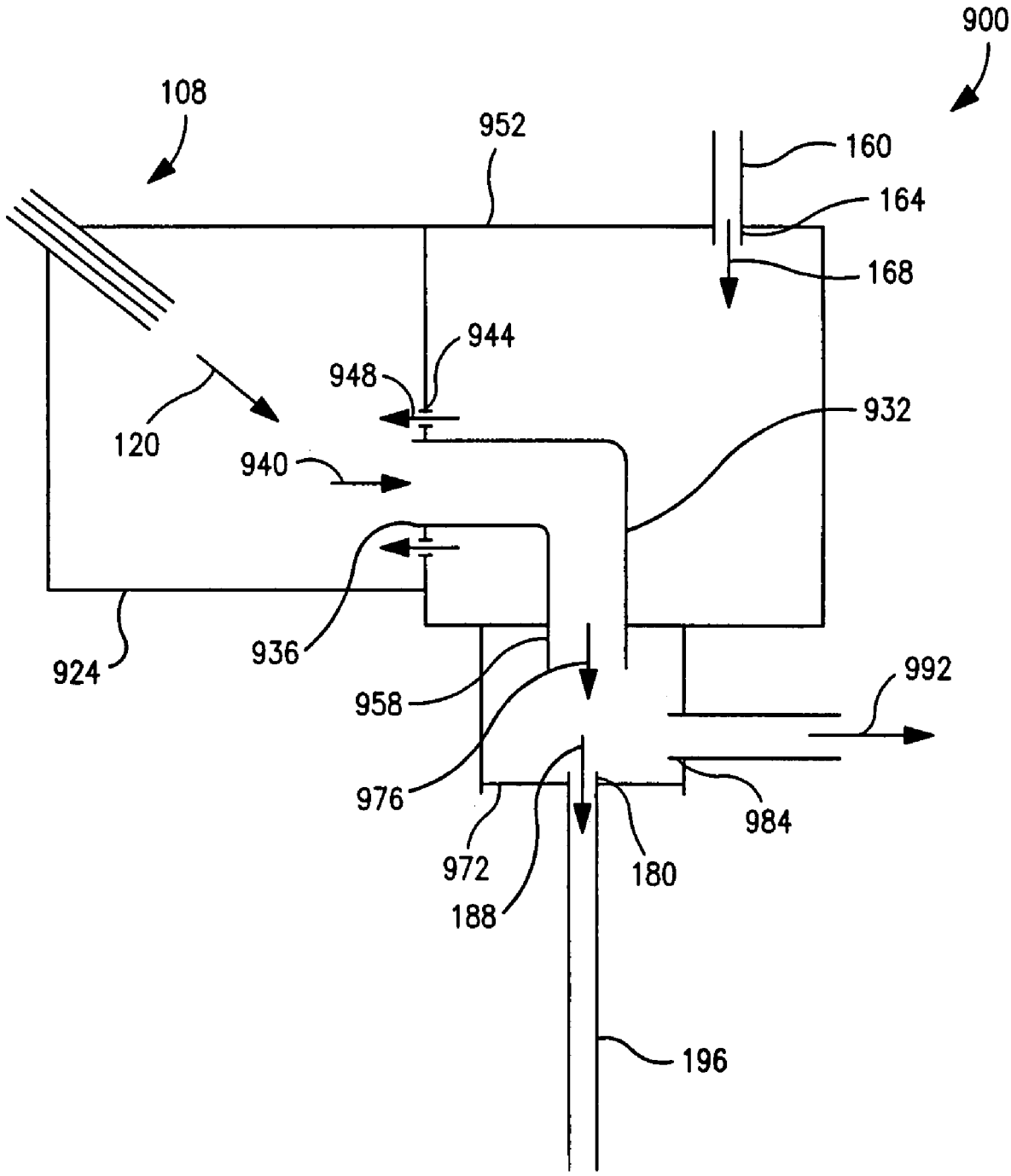
FIG. 9 is a schematic view of an example of an ionization apparatus according to another implementation.

FIG. 9 is a schematic view of another example of an ionization apparatus or system 900. The ionization apparatus 900 is similar to the ionization apparatus 800 described above and illustrated in FIG. 8. FIG. 9, however, illustrates that other features described earlier in this disclosure in connection with FIGS. 1-7 may also be applied to the ionization apparatus 800 or 900 illustrated in FIGS. 8 or 9. For instance, FIG. 9 illustrates a large-diameter sample conduit 932 that includes a nonlinear feature. FIG. 9 also illustrates an interface chamber 952 between a sample receiving chamber 924 and an ion extraction chamber 972. The drying gas source inlet 164 of the drying gas source 160 is positioned relative to the sample conduit 932 and a drying gas outlet (e.g., one or more orifices) 944 so as to provide effective thermal energy transfer from the drying gas introduced into the interface chamber 952 to the sample conduit 932.

In the implementations illustrated in FIGS. 8 and 9, the sample conduits 832 and 932 may include one or more apertures similar to the aperture 169 alternatively or additionally provided with the sample conduit 132 illustrated in FIG. 1. Moreover, the pressure-length product (Torr–cm) characterizing the sample conduit 832 or 932 may be as provided above in connection with the implementation corresponding to FIG. 1.

It will be further understood that various aspects or details of the invention may be changed without departing from the scope of the invention. Furthermore, the foregoing description is for the purpose of illustration only, and not for the purpose of limitation—the invention being defined by the claims.

What is claimed is:

1. An ionization apparatus comprising:

an interface chamber defined by a plurality of boundaries; and a heated sample conduit extending through the interface chamber, the sample conduit comprising an inlet and an outlet, each positioned within at least one of the boundaries and establishing a sample material flow path separated from an interface chamber interior, wherein within the sample conduit a drying gas is mixed with the sample material flow and the product of the pressure times the length of said conduit is equal or greater than 50 Torr×cm.

2. The ionization apparatus of claim 1, wherein within the sample conduit the drying gas is mixed with the sample material flow and the product of the pressure times the length of said conduit is in a range between 100 and 10,000 Torr×cm.

3. The ionization apparatus of claim 1, wherein within the sample conduit the drying gas is mixed with the sample material flow and the product of the pressure times the length of said conduit is in a range between 200 and 2000 Torr×cm.

4. The ionization apparatus of claim 1, wherein the sample conduit further comprises a nonlinear section whereby the sample material flow path includes a turn.

5. The ionization apparatus of claim 1, wherein an axis of the sample conduit inlet is parallel to an axis of the sample conduit outlet.

6. The ionization apparatus of claim 1, wherein an axis of the sample conduit inlet is oriented at a non-zero angle relative to an axis of the sample conduit outlet.

7. The ionization apparatus of claim 1, further comprising a drying gas outlet communicating with the interface chamber interior and having a plurality of drying gas outlet orifices arranged around the sample conduit inlet.

8. The ionization apparatus of claim 7, wherein the sample conduit comprises at least one opening for introducing drying gas therein.

9. The ionization apparatus of claim 1, further comprising a device for accelerating or decelerating ions in the sample conduit.

10. The ionization apparatus of claim 1, further comprising:

an ion extraction chamber communicating with the sample conduit outlet and comprising an ion exit aperture and an exhaust aperture; and a device for applying an electrical field in the ion extraction chamber of a polarity opposite to the polarity of ions entering the ion extraction chamber from the sample conduit outlet.

11. The ionization apparatus of claim 1, further comprising:

a sample receiving chamber including a boundary defining a sample receiving chamber interior;

an ion extraction chamber separate from the sample receiving chamber and comprising an ion exit aperture and an exhaust aperture;

the inlet of the sample conduit communicating with the sample receiving chamber, the outlet communicating with the ion extraction chamber, and a length of the sample conduit extending between the inlet and the outlet outside the sample receiving chamber, the sample conduit further including a nonlinear section located in the length; and a drying gas inlet communicating with the interface chamber, wherein the sample material flow path runs from the sample receiving chamber to the ion extraction chamber separate from the interface chamber interior, and the interface chamber establishes a drying gas flow path from the drying gas inlet, around the sample conduit and to the drying gas outlet.

12. The ionization apparatus of claim 11, wherein the nonlinear section includes a bend.

13. The ionization apparatus of claim 11, wherein the nonlinear section includes a coiled section.

14. The ionization apparatus of claim 1, further comprising:

a sample receiving chamber communicating with the sample conduit inlet;

a sample ionizing device communicating with the sample receiving chamber;

a drying gas outlet communicating with the sample receiving chamber; and an ion extraction chamber receiving the sample conduit outlet, the ion extraction chamber including an ion exit orifice spaced from the sample conduit outlet by a gap, an inside diameter of the ion exit orifice being less than an inside diameter of the sample conduit outlet, and a central axis of the ion exit orifice being substantially coincident with a central axis of the sample conduit outlet.

15. The ionization apparatus of claim 14, wherein the sample conduit has a substantially straight cross-section from the sample conduit inlet to the sample conduit outlet, whereby the sample conduit establishes a substantially straight sample material flow path from the sample receiving chamber to the ion extraction chamber.

16. The ionization apparatus of claim 14, wherein the sample conduit includes a nonlinear section located between the sample conduit inlet and the sample conduit outlet, whereby the sample conduit establishes a sample material flow path that includes a turn.

17. The ionization apparatus of claim 14, further including means for maintaining the pressure in the sample receiving chamber to an above-atmospheric pressure, and means for maintaining the pressure in the ion extraction chamber at atmospheric pressure.

18. A method for extracting ions from a sample material comprising:

ionizing sample material in a sample receiving chamber;

providing a sample conduit within an interface chamber;

flowing drying gas into the sample conduit for mixing an ionized sample material with the drying gas for obtaining within the sample conduit the product of the pressure times the length of the conduit being equal or greater than 50 Torr×cm.

19. The method of claim 18, wherein the sample conduit defines a flow path for the ionized sample material and drying gas that includes a turn in the sample conduit.

20. The method of claim 18, further comprising flowing the ionized sample material from the sample conduit into an ion extraction chamber, and applying an electrical field in the ion extraction chamber having a polarity opposite to the polarity of ions of the ionized sample material flowing into the ion extraction chamber to slow the flow rate of the ions as the ions enter the ion extraction chamber.

21. The method of claim 18, further comprising applying a voltage jump to the ionized sample material flowing through the sample conduit whereby charged species of the ionized sample material are accelerated or decelerated relative to uncharged species of the ionized sample material and the drying gas.

22. The method of claim 18, further comprising:

ionizing sample material in a sample receiving chamber at a pressure above atmospheric pressure; and flowing at least a portion of the ionized sample material along with drying gas from the sample receiving chamber, through the sample conduit and to an ion extraction chamber, the ion extraction chamber being at atmospheric pressure.

23. The method of claim 18, further including flowing ions of the ionized sample material received in an ion extraction chamber into a sampling orifice communicating with a sub-atmospheric region of an analytical instrument.

24. The method of claim 23, wherein the ionized sample material is received in the ion extraction chamber via an outlet of the sample conduit having a central axis substantially coincident with the central axis of the sampling orifice, and the ions are flowed into the sampling orifice along a substantially linear flow path.

* * * * *